US007682245B2

(12) United States Patent
Nguyen

(10) Patent No.: US 7,682,245 B2
(45) **Date of Patent: *Mar. 23, 2010**

(54) NAME YOUR PRIZE GAME PLAYING METHODOLOGY

(75) Inventor: Binh T. Nguyen, Reno, NV (US)

(73) Assignee: IGT, Reno, NV (US)

( * ) Notice: Subject to any disclaimer, the term of this patent is extended or adjusted under 35 U.S.C. 154(b) by 1366 days.

This patent is subject to a terminal disclaimer.

(21) Appl. No.: 11/051,489

(22) Filed: Feb. 4, 2005

(65) Prior Publication Data

US 2005/0176498 A1 Aug. 11, 2005

Related U.S. Application Data

(63) Continuation-in-part of application No. 09/515,717, filed on Feb. 29, 2000, now Pat. No. 6,857,959.

(51) Int. Cl.
*A63F 9/24* (2006.01)

(52) U.S. Cl. ..... 463/25; 463/9; 463/16; 463/20; 463/42; 700/91; 340/323 R

(58) Field of Classification Search ..... None
See application file for complete search history.

(56) References Cited

U.S. PATENT DOCUMENTS 5,280,909 A * 1/1994 Tracy ..... 463/27
5,324,041 A 6/1994 Boylan et al.
5,324,922 A 6/1994 Roberts
5,643,086 A 7/1997 Alcorn et al.
5,655,961 A 8/1997 Acres et al.
5,702,304 A 12/1997 Acres et al.
5,722,891 A * 3/1998 Inoue ..... 463/20
5,741,183 A 4/1998 Acres et al.
5,752,882 A 5/1998 Acres et al.

(Continued)

FOREIGN PATENT DOCUMENTS

WO WO 99/16519 4/1999

OTHER PUBLICATIONS

U.S. Appl. No. 11/225,299 entitled Universal Casino Bonusing Systems and Methods, filed Sep. 12, 2005.

(Continued)

*Primary Examiner*—M. Sager
(74) *Attorney, Agent, or Firm*—Weaver Austin Villeneuve & Sampson LLP

(57) ABSTRACT

A disclosed gaming machine has a memory storing a list of one or more prizes, a prize display for viewing prize information, and a prize selection mechanism that allows a user playing a game on the gaming machine to select one or more prizes specific to one or more outcomes of the game played on the gaming machine. One or more gaming machines may be connected in a "prize distribution network" to a "prize server." The prize server may include an interface for providing prize information to the gaming machines connected in the prize distribution network and a memory storing the prize information as groups of prizes for separate display on the gaming machines. With the prize server and prize distribution network, the prizes available as an award on each gaming machine in the prize distribution network may be easily changed.

43 Claims, 9 Drawing Sheets

U.S. PATENT DOCUMENTS

| | | | | |
|---|---|---|---|---|
| 5,759,102 | A | 6/1998 | Pease et al. | |
| 5,768,382 | A * | 6/1998 | Schneier et al. | 380/251 |
| 5,800,269 | A | 9/1998 | Holch et al. | |
| 5,813,673 | A | 9/1998 | Richardson | |
| 5,820,459 | A | 10/1998 | Acres et al. | |
| 5,836,817 | A | 11/1998 | Acres et al. | |
| 5,848,932 | A | 12/1998 | Adams | |
| 5,851,147 | A | 12/1998 | Stupak | |
| 5,876,284 | A | 3/1999 | Acres et al. | |
| 5,877,633 | A | 3/1999 | Ng et al. | |
| 5,895,047 | A | 4/1999 | Callahan | |
| 5,902,184 | A | 5/1999 | Bennett | |
| 5,902,983 | A | 5/1999 | Crevelt et al. | |
| 6,015,344 | A | 1/2000 | Kelly et al. | |
| 6,048,269 | A | 4/2000 | Burns et al. | |
| 6,068,552 | A | 5/2000 | Walker | |
| 6,102,403 | A | 8/2000 | Kaufman | |
| 6,104,815 | A | 8/2000 | Alcorn et al. | |
| 6,106,396 | A | 8/2000 | Alcorn et al. | |
| 6,110,041 | A | 8/2000 | Walker et al. | |
| 6,149,522 | A | 11/2000 | Alcorn et al. | |
| 6,213,877 | B1 | 4/2001 | Walker | |
| 6,219,836 | B1 * | 4/2001 | Wells et al. | 717/178 |
| 6,224,483 | B1 * | 5/2001 | Mayeroff | 463/20 |
| 6,293,866 | B1 | 9/2001 | Walker et al. | |
| 6,315,665 | B1 | 11/2001 | Faith | |
| 6,347,738 | B1 | 2/2002 | Crevelt et al. | |
| 6,364,768 | B1 | 4/2002 | Acres et al. | |
| 6,547,131 | B1 | 4/2003 | Foodman et al. | |
| 6,565,434 | B1 | 5/2003 | Acres | |
| 6,569,015 | B1 | 5/2003 | Baerlocher et al. | |
| 6,585,588 | B2 | 7/2003 | Hartl | |
| 6,585,598 | B2 | 7/2003 | Nguyen et al. | |
| 6,597,197 | B1 | 7/2003 | Mosley et al. | |
| 6,605,000 | B2 | 8/2003 | Adams | |
| 6,620,047 | B1 | 9/2003 | Alcorn et al. | |
| 6,628,939 | B2 | 9/2003 | Paulsen | |
| 6,638,170 | B1 | 10/2003 | Crumby | |
| 6,645,077 | B2 * | 11/2003 | Rowe | 463/42 |
| 6,676,512 | B2 | 1/2004 | Fong et al. | |
| 6,676,522 | B2 | 1/2004 | Rowe et al. | |
| 6,682,421 | B1 | 1/2004 | Rowe et al. | |
| 6,692,355 | B2 | 2/2004 | Baerlocher et al. | |
| 6,712,693 | B1 | 3/2004 | Hettinger | |
| 6,712,694 | B1 | 3/2004 | Nordman | |
| 6,726,563 | B1 | 4/2004 | Baerlocher et al. | |
| 6,739,505 | B2 | 5/2004 | Walker et al. | |
| 6,739,975 | B2 | 5/2004 | Nguyen et al. | |
| 6,749,502 | B2 | 6/2004 | Baerlocher | |
| 6,780,111 | B2 | 8/2004 | Cannon et al. | |
| 6,800,029 | B2 | 10/2004 | Rowe et al. | |
| 6,805,634 | B1 | 10/2004 | Wells et al. | |
| 6,814,664 | B2 | 11/2004 | Baerlocher et al. | |
| 6,827,646 | B2 | 12/2004 | Adams | |
| 6,834,796 | B2 | 12/2004 | Anvekar et al. | |
| 6,846,238 | B2 | 1/2005 | Wells | |
| 6,855,052 | B2 | 2/2005 | Weiss et al. | |
| 6,857,959 | B1 | 2/2005 | Nguyen | |
| 6,875,959 | B1 | 2/2005 | Nguyen | |
| 6,866,586 | B2 | 3/2005 | Oberberger et al. | |
| 6,910,964 | B2 | 6/2005 | Acres | |
| 6,913,533 | B2 | 7/2005 | Cuddy et al. | |
| 6,921,335 | B2 | 7/2005 | Rodgers et al. | |
| 6,923,720 | B2 | 8/2005 | Loose | |
| 6,923,724 | B2 | 8/2005 | Williams | |
| 6,935,952 | B2 | 8/2005 | Walker et al. | |
| 6,939,224 | B2 | 9/2005 | Palmer et al. | |
| 6,942,567 | B2 | 9/2005 | Baerlocher et al. | |
| 6,962,530 | B2 | 11/2005 | Jackson | |
| 6,971,956 | B2 | 12/2005 | Rowe et al. | |
| 6,974,129 | B2 | 12/2005 | Nordman | |
| 6,979,266 | B2 | 12/2005 | Lemay et al. | |
| 6,988,267 | B2 | 1/2006 | Harris et al. | |
| 7,001,273 | B2 | 2/2006 | Baerlocher | |
| 7,001,278 | B2 | 2/2006 | Maya et al. | |
| 7,008,324 | B1 | 3/2006 | Johnson et al. | |
| 7,043,641 | B1 | 5/2006 | Martinek et al. | |
| 2002/0098888 | A1 | 7/2002 | Rowe et al. | |
| 2002/0116615 | A1 | 8/2002 | Nguyen et al. | |
| 2002/0142846 | A1 | 10/2002 | Paulsen | |
| 2002/0147049 | A1 | 10/2002 | Carter, Sr. | |
| 2002/0165630 | A1 | 11/2002 | Arthur et al. | |
| 2002/0173354 | A1 | 11/2002 | Winans et al. | |
| 2002/0193158 | A1 | 12/2002 | Weiss et al. | |
| 2002/0198043 | A1 | 12/2002 | Chowdhury | |
| 2003/0027625 | A1 | 2/2003 | Rowe | |
| 2003/0027628 | A1 | 2/2003 | Luciano | |
| 2003/0032479 | A1 | 2/2003 | LeMay et al. | |
| 2003/0036425 | A1 | 2/2003 | Kaminkow et al. | |
| 2003/0040358 | A1 | 2/2003 | Rothkranz et al. | |
| 2003/0045353 | A1 | 3/2003 | Paulsen et al. | |
| 2003/0054878 | A1 | 3/2003 | Benoy et al. | |
| 2003/0054887 | A1 | 3/2003 | Dettrey et al. | |
| 2003/0060269 | A1 | 3/2003 | Paulsen et al. | |
| 2003/0064773 | A1 | 4/2003 | Baerlocher et al. | |
| 2003/0069063 | A1 | 4/2003 | Bilyeu et al. | |
| 2003/0083943 | A1 | 5/2003 | Adams et al. | |
| 2003/0171145 | A1 | 9/2003 | Rowe | |
| 2003/0176214 | A1 | 9/2003 | Burak et al. | |
| 2003/0191809 | A1 | 10/2003 | Mosley et al. | |
| 2003/0216173 | A1 | 11/2003 | Gauselmann | |
| 2004/0002372 | A1 | 1/2004 | Rodgers et al. | |
| 2004/0002381 | A1 | 1/2004 | Alcorn et al. | |
| 2004/0018879 | A1 | 1/2004 | Borg | |
| 2004/0038721 | A1 | 2/2004 | Wells | |
| 2004/0043813 | A1 | 3/2004 | Chamberlain et al. | |
| 2004/0048645 | A1 | 3/2004 | Webb et al. | |
| 2004/0048649 | A1 | 3/2004 | Peterson et al. | |
| 2004/0053659 | A1 | 3/2004 | Rothkranz et al. | |
| 2004/0053671 | A1 | 3/2004 | Nordman | |
| 2004/0087355 | A1 | 5/2004 | Toyoda | |
| 2004/0087360 | A1 | 5/2004 | Chamberlain et al. | |
| 2004/0092312 | A1 | 5/2004 | Toyoda | |
| 2004/0132522 | A1 | 7/2004 | Seelig et al. | |
| 2004/0142740 | A1 | 7/2004 | Damico et al. | |
| 2004/0142744 | A1 | 7/2004 | Atkinson et al. | |
| 2004/0147309 | A1 | 7/2004 | Chamberlain et al. | |
| 2004/0152520 | A1 | 8/2004 | Shinoda | |
| 2004/0214630 | A1 | 10/2004 | Mayeroff | |
| 2004/0242305 | A1 | 12/2004 | Baerlocher | |
| 2004/0248648 | A1 | 12/2004 | Rothschild et al. | |
| 2004/0258647 | A1 | 12/2004 | Ruppert et al. | |
| 2005/0009601 | A1 | 1/2005 | Manfredi et al. | |
| 2005/0026678 | A1 | 2/2005 | Kminkow | |
| 2005/0026694 | A1 | 2/2005 | Kelly et al. | |
| 2005/0037829 | A1 | 2/2005 | Baerlocher et al. | |
| 2005/0054412 | A1 | 3/2005 | Gauselmann | |
| 2005/0054413 | A1 | 3/2005 | Randall et al. | |
| 2005/0054424 | A1 | 3/2005 | Rothkranz et al. | |
| 2005/0054428 | A1 | 3/2005 | Nordman et al. | |
| 2005/0054437 | A1 | 3/2005 | Baerlocher et al. | |
| 2005/0056996 | A1 | 3/2005 | Nordman | |
| 2005/0059454 | A1 | 3/2005 | McComb et al. | |
| 2005/0059459 | A1 | 3/2005 | Dunn et al. | |
| 2005/0059469 | A1 | 3/2005 | Gail et al. | |
| 2005/0059477 | A1 | 3/2005 | Baerlocher | |
| 2005/0059478 | A1 | 3/2005 | Peterson et al. | |
| 2005/0070353 | A1 | 3/2005 | Webb et al. | |
| 2005/0079911 | A1 | 4/2005 | Nakatsu | |
| 2005/0098888 | A1 | 5/2005 | Akram | |
| 2005/0101383 | A1 | 5/2005 | Wells | |
| 2005/0119039 | A1 | 6/2005 | Berman et al. | |
| 2005/0124405 | A1 | 6/2005 | Nordman | |
| 2005/0136949 | A1 | 6/2005 | Barnes, Jr. | |

2005/0143165 A1 6/2005 Berman et al.
2005/0148383 A1 7/2005 Mayeroff
2005/0153776 A1 7/2005 LeMay et al.
2005/0170884 A1 8/2005 Okada
2005/0176498 A1 8/2005 Nguyen
2005/0198318 A1 9/2005 Von Mueller et al.
2005/0215323 A1 9/2005 Miyamoto et al.
2005/0227755 A1 10/2005 Nordman
2005/0245313 A1 11/2005 Yoshino et al.
2005/0250577 A1 11/2005 Adams
2005/0266913 A1 12/2005 Nordman
2005/0270368 A1 12/2005 Hashimoto
2006/0009285 A1 1/2006 Pryzby et al.
2006/0019738 A1 1/2006 Baerlocher et al.
2006/0025195 A1 2/2006 Pennington et al.
2006/0025200 A1 2/2006 Van Asdale
2006/0025201 A1 2/2006 Van Asdale
2006/0025209 A1 2/2006 Walker et al.
2006/0040735 A1 2/2006 Baerlocher
2006/0040743 A1 2/2006 Saffari et al.
2006/0046818 A1 3/2006 Goins
2006/0046839 A1 3/2006 Nguyen
2006/0049624 A1 3/2006 Brosnan et al.
2006/0063584 A1 3/2006 Brill et al.
2006/0068875 A1 3/2006 Cregan et al.
2006/0068897 A1 3/2006 Sanford et al.
2006/0068900 A1 3/2006 Englman
2006/0073873 A1 4/2006 Rodgers et al.
2006/0073877 A1 4/2006 Rodgers et al.
2006/0073878 A1 4/2006 Shackelford et al.
2006/0073887 A1 4/2006 Nguyen et al.
2006/0111168 A1 5/2006 Nguyen et al.
2007/0129139 A1 6/2007 Nguyen et al.

OTHER PUBLICATIONS

Spielo Gaming International, www.spielo.com, Dec. 6, 2000.
Oracle Corporation, www.oracle.com/collateral/ent_partioning_fo.pdf, Feb. 1999.
International Search Report and Written Opinion dated Jul. 10, 2006 from corresponding PCT Application No. PCT/US2006/007069 11 pages.
Non-Final Office Action from U.S. Appl. No. 09/515,717, dated Oct. 9, 2001.
Final Office Action from U.S. Appl. No. 09/515,717, dated Sep. 11, 2002.
Non-Final Office Action from U.S. Appl. No. 09/515,717, dated Mar. 18, 2003.
Final Office Action from U.S. Appl. No. 09/515,717, dated Aug. 19, 2003.
Notice of Allowance dated Sep. 30, 2004 from related U.S. Appl. No. 09/515,517.
"Universal Casino Bonusing Systems and Methods," U.S. Application filed Sep. 12, 2005 from U.S. Appl. No. 11/225,299.
ISR and Written Opinion dated Aug. 4, 2008 from corresponding PCT Application No. PCT/US2007/081856, 11 pgs.

* cited by examiner

Figure 6A
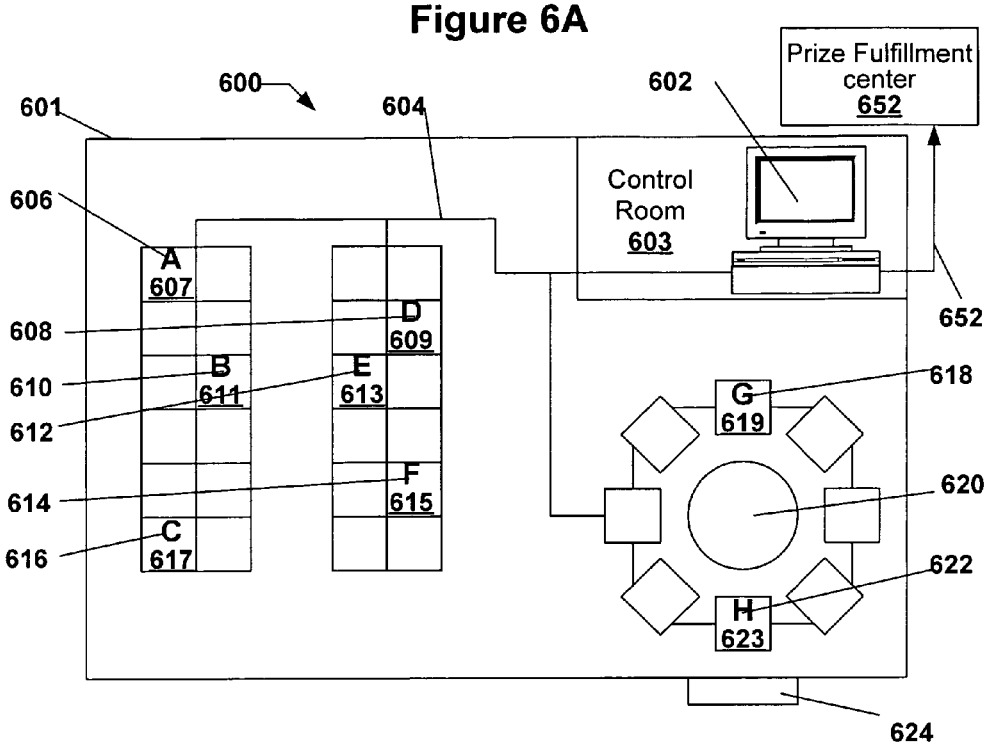
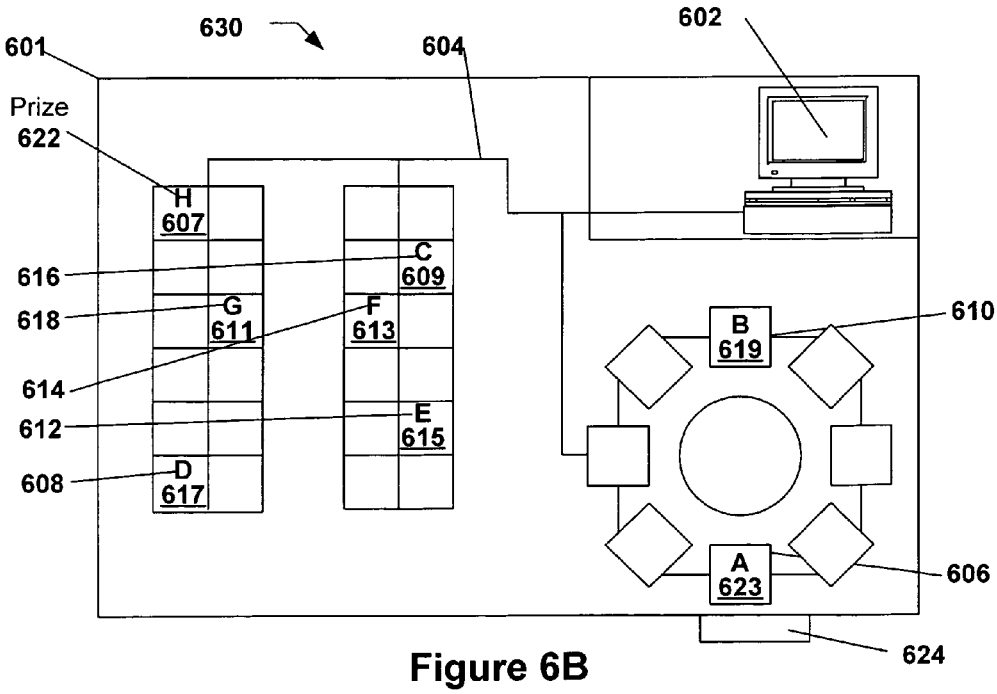
Figure 6B

NAME YOUR PRIZE GAME PLAYING METHODOLOGY

CROSS-REFERENCE TO RELATED APPLICATIONS

This application is a continuation-in-part application and claims priority under 35 U.S.C. §120 from U.S. application Ser. No. 09/515,717 filed Feb. 29, 2000 now U.S. Pat. No. 6,857,959 naming Binh Nguyen as inventor, and titled "NAME YOUR PRIZE GAME PLAYING METHODOLOGY," which is incorporated herein in its entirety and for all purposes.

BACKGROUND OF THE INVENTION

This invention relates to game playing methods for gaming machines such as slot machines and video poker machines. More particularly, the present invention relates to methods of allowing game players to select prizes on gaming machines.

There are a wide variety of associated devices that can be connected to a gaming machine such as a slot machine or video poker machine. Some examples of these devices are lights, ticket printers, card readers, speakers, bill validators, coin acceptors, display panels, key pads, and button pads. Many of these devices are built into the gaming machine. Often, a number of devices are grouped together in a separate box that is placed on top of the gaming machine. Devices of this type are commonly called a top box. Typically, each top box is designed specifically for a game title.

Typically, the gaming machine controls various combinations of devices. These devices provide gaming features that augment the features of the gaming machine. Further, many devices such as top boxes are designed to be removable from the gaming machine to provide flexibility in selecting the game features of a given gaming machine.

An important feature of a gaming machine is a programmed pay-out table. Typically, the pay-out table relates the outcome of a game on the gaming machine to a particular prize associated with the outcome of the game. For example, a pay-out table on a slot machine might specify the required pay-out when a play results in three cherries. The pay-out can vary depending upon how many coins are played; e.g., the pay-out is 10 coins when one coin is wagered in the game, 20 coins when two coins are wagered in the game and 40 coins when three coins are wagered in the game. The pattern of relating an outcome to the pay-out, which may be a function of the wager amount, is usually displayed or described for all of the potential outcomes of a game. Often a part of a pay-out table is displayed on a gaming machine. In fact, many gaming machine features including the lights and the display panels may be utilized to draw a players attention to the pay-out table to heighten the players interest in playing a game.

The odds of a particular outcome of a game on a gaming machine may be a function of the rules of the game or may be designated by the operator of the gaming machine. For example, the odds of obtaining a certain poker hand on a video poker machine may be a known function of the possible combinations of cards in a standard 52 card playing deck. However, for a slot machine, the odds of a particular outcome of a slot game on a video or mechanical slot machine may be increased or decreased for a particular machine. The odds and pay-out usually remain fixed for a particular gaming machine so long as it is programmed to play a particular game.

For a particular game on a gaming machine, a maximum prize or pay-out will be offered. This maximum prize or jackpot will usually correspond to the outcome of a game on a gaming machine that has the lowest odds of occurring. For example, on a video poker machine, a jackpot is usually offered when the outcome of a game is a royal flush. This is because the royal flush typically has the lowest odds of occurring during a particular game of video poker. The maximum prize offered may be also a function of the wager amount. For example, on a video poker machine, a jackpot may only be offered when the outcome of a game is a royal flush and the maximum wager on a game has been made.

For a single gaming machine, the jackpot is usually cash or a particular prize. For example, for a slot machine with a maximum wager of 3 coins, the jackpot might be 5,000 coins when 3 coins are wagered on a particular game. As another example, for a video poker machine, with a maximum wager of 3 coins, the jackpot might be a car when 3 coins are wagered. Usually, the jackpot, the pay-out table and the odds for each outcome in the pay-out table are fixed on a single gaming machine and may not be changed by the player.

For multiple gaming machines linked by a network, the jackpot on a single gaming machine may vary in time. For example, the amount of money entered into a group of gaming machines can be pooled together to provide a larger jackpot for groups of gaming machines linked together as part of a wide area progressive network or a casino area network. As money is entered into an individual gaming machine, this information can be relayed over the communication network to a central location where the total amount of money in the jackpot is tracked for the group of gaming machines linked together. The information on the total jackpot, which changes with time, can be sent out over the wide area progressive network or casino area network to display signs displaying the jackpot amount. Thus, the jackpot amount for a gaming machine linked to a wide area progressive network or casino area network will increase with time until the jackpot is reset. However, the odds of winning the jackpot remain fixed.

Disadvantages of the current method for offering prizes and pay-outs on a gaming machine is that the jackpot and the odds of winning the jackpot are fixed when a player initiates a game on the gaming machine. Further not all valuable prizes are universally appreciated. Some players may be more motivated to win cash and others to win cruises or automobiles. The fixed jackpot and odds of winning the jackpot may discourage game play in certain situations. For example, when the jackpot for a slot machine is a motorcycle, some players may not play a game on the slot machine because the players are not interested in winning a motorcycle. As another example, after a jackpot is won on a group of machines linked by a wide area progressive network, the jackpot on the machines usually reverts to some minimum amount. Some players may avoid playing these gaming machines while the jackpot is small because the maximum winnings are so small. Accordingly, it would be desirable to provide a game playing methodology for gaming machines which allows a player to select the prizes or jackpot that may be won on a particular gaming machine where the odds of winning the prize or jackpot are a function of the prize selected.

Another disadvantage of the current method of offering prizes in pay-outs on a gaming machine results from the difficulty in changing the prizes associated with individual machines. Often casinos find that particular arrangements of gaming machines, each with different prizes, on the casino floor maximize play. Specifically, games may be placed in certain locations on the floor to attract customers into the casino and maximize game play on the various gaming machines. For example, a gaming machine offering a particular prize, which is popular, might be placed near the door to attract customers into the casino. In fact, the distribution of gaming machines on a casino floor is sometimes considered a proprietary secret of casinos.

Over time, what was once a very enticing arrangement becomes less interesting to players. However, play can be increased again by rearranging the layout of gaming machines on the casino floor. Unfortunately, changing the distribution of prizes on the casino floor requires that someone physically move the gaming machines to different locations. This can be a very tedious and time-consuming exercise. Accordingly, it would be desirable to provide a game playing methodology for gaming machines which allows the prizes offered on each gaming machine to be changed more easily.

SUMMARY OF THE INVENTION

This invention addresses the indicated above by providing a gaming machine having a memory storing a list of one or more prizes, a prize display mechanism for viewing prize information, and a prize selection mechanism that allows a user to select one or more prizes specific to one or more outcomes of a game played on the gaming machine. One or more gaming machines may be connected in a "prize distribution network" to a "prize server." The prize server may include an interface for providing prize information to the gaming machines connected in the prize distribution network and a memory storing the prize information as groups of prizes for separate display on the gaming machines. With the prize server and prize distribution network, the prizes available as an award on each gaming machine in the prize distribution network may be easily changed.

One aspect of the present invention provides a gaming machine that generally can be characterized as including (1) a memory storing a list of one or more prizes, (2) a prize display mechanism displaying one or more prizes available to a user and (3) a prize selection mechanism that allows the user to select one or more prizes specific to one or more outcomes of a game played on the gaming machine. The gaming machine may be a mechanical slot machine, a video slot machine, a keno game, a lottery game, or a video poker game and the list of prizes available for selection may include merchandise, vacations, airline miles, shopping sprees and cash. In one embodiment, a probability of the outcome of the game played on the gaming machine is specific to a value of the selected prize.

In preferred embodiments, the list of prizes is stored in a memory selected from the group consisting of a EEPROM, DVD, a CD-ROM, a non-volatile memory, or a magnetic storage device. A player may select prizes using a key pad, a button panel, a touch screen, a mouse, a touch pad, a joystick, a microphone, or a magnetic card. Further, the prize selection mechanism may allow the user to select one or more prizes specific to a wager amount of the game played on the gaming machine.

In one embodiment, the gaming machine provides a display format for the one or more prizes displayed on the display mechanism where the prize display mechanism may be a printed sign, a video display screen, a bonus wheel, a video touch screen, an LCD, a back-lit glass panel or a prize. The display format may be graphical or textual. Further, the display format may indicate a feature of the prize including the value of the prize or a prize theme.

Another aspect of the invention provides a prize server that can be generally characterized as including (1) an interface for providing prize information to one or more gaming machines and (2) a memory storing the prize information as groups of prizes for separate display on the one or more gaming machines. The prizes may be merchandise, vacations, airline miles, shopping sprees and cash. In preferred embodiments, the interface is a fiber optic cable, a coaxial cable, or a wireless interface, the display is a video display screen, a touch screen, or a LCD, and the memory is a CD-ROM, a non-volatile memory, or a magnetic storage. Further, the prize server may include a second interface to an output mechanism including a printer, an optical card reader, a smart card reader, a mechanism for electronically crediting a pre-existing account or a magnetic card reader.

Another aspect of the invention provides a prize distribution network that can be generally characterized as including (1) a prize server and (2) a plurality gaming machines. As described above, the prize server should include an interface for providing prize information to one or more gaming machines and a memory storing the prize information as groups of prizes for separate display on the one or more gaming machines. Each gaming machines preferably includes (a) a memory storing a list of one or more prizes and a prize display mechanism displaying one or more prizes and (b) a prize selection mechanism that allows a user to select one or more prizes specific to one or more an outcomes of a game played on the gaming machine. In preferred embodiments, the gaming machine may be a mechanical slot machine, a video slot machine, a keno game, a lottery game, or a video poker game and the prizes are merchandise, vacations, airline miles, shopping sprees and cash.

Another aspect of the invention provides a method of selecting a prize specific to an outcome of a game played on a gaming machine, the method may be characterized as including the following steps (1) displaying multiple prizes available for selection in the prize display mechanism (2) receiving an input signal from the prize selection mechanism for selecting a prize from the list of prizes where the input signal corresponds to a user's selection of the selected prize (3) receiving a game play signal and determining the game play outcome (4) presenting the game play and game play outcome. In preferred embodiments, the method may include one or more of the following steps (a) receiving a wager amount prior to receiving an input signal from the prize selection mechanism and (b) displaying a group of prizes available for selection in the prize display mechanism specific to the wager amount (c) determining a pay table to be used in determining a game play outcome where the play table is chosen according to the value of the selected prize (d) outputting the selected prizes to a portable memory device where the portable memory device is a paper printout, a magnetic card or a smart card.

Another aspect of the present invention provides a method for distributing information about prizes available on specific gaming machines that may be generally characterized as including the following steps (1) establishing communication with each gaming machine connected to the prize server and (2) sending prize information from a memory on the prize server to a memory on each gaming machine where the prize information is specific to prizes which are available for selection by game players as game awards on games played on the gaming machines. In preferred embodiments, the method may include one or more of the following steps, (a) displaying the prize information to a video display screen associated with one or more of the gaming machines (b) identifying one or more prizes selected by a user and (c) comprising outputting the selected prize information to a portable storage device, which can be read by one or more of the gaming machines.

Another aspect of the invention pertains to computer program products including a machine-readable medium on which is stored program instructions for implementing any of the methods described above. Any of the methods of this invention may be represented as program instructions and/or data structures, databases, etc. that can be provided on such computer readable media.

These and other features of the present invention will be presented in more detail in the following detailed description of the invention and the associated figures.

BRIEF DESCRIPTION OF THE DRAWINGS

FIGS. 6A and 6B are block diagrams depicting a casino floor having gaming machines in a fixed physical arrangement, in which the distribution of prize groups on the gaming machines is varied using a prize server network for one embodiment of the present invention.

DESCRIPTION OF THE PREFERRED EMBODIMENTS

Figure 1:
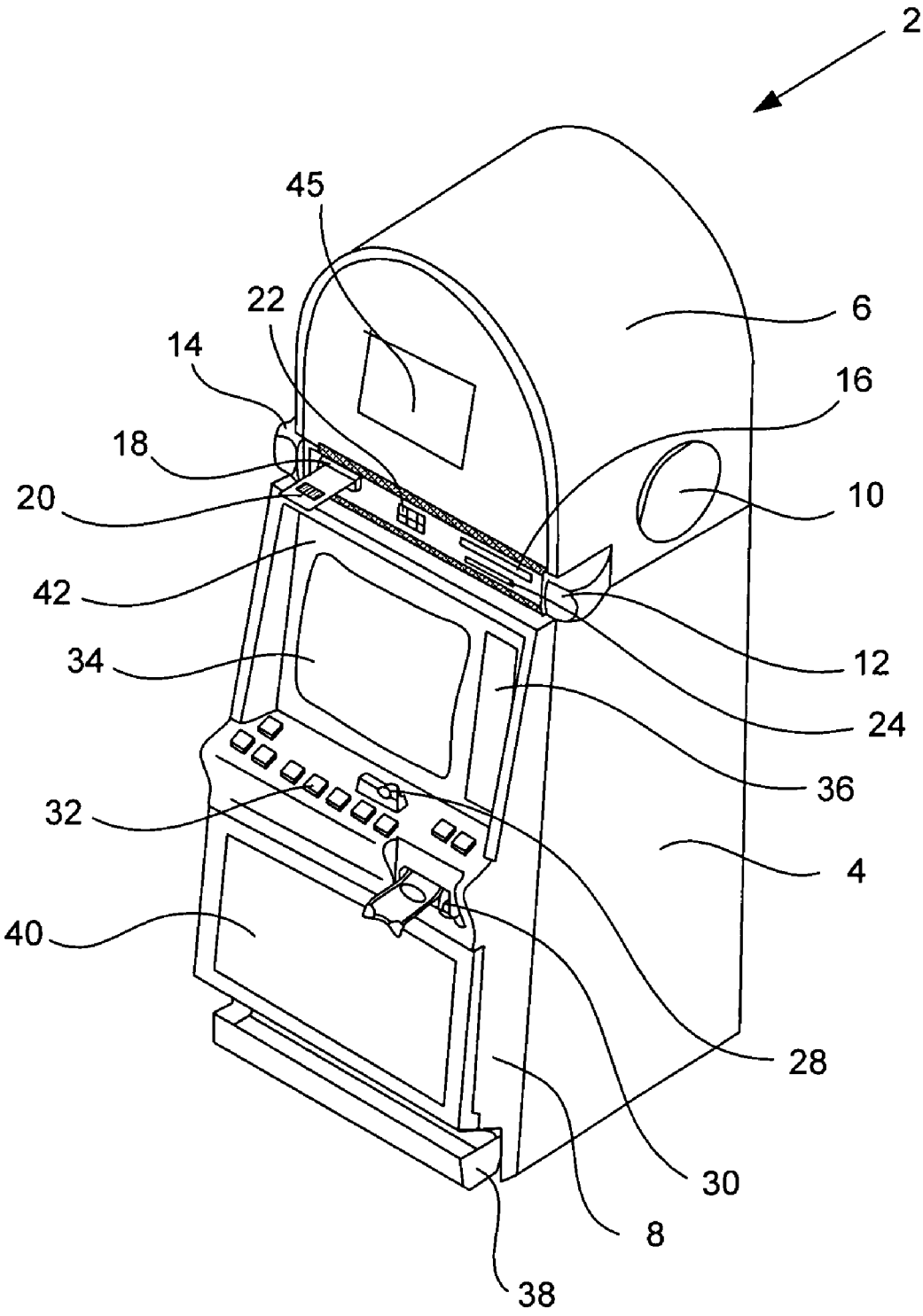
FIG. 1 is a perspective drawing of a gaming machine having a top box and other devices.

Turning first to FIG. 1, a video gaming machine 2 of the present invention is shown. Machine 2 includes a main cabinet 4, which generally surrounds the machine interior (not shown) and is viewable by users. The main cabinet includes a main door 8 on the front of the machine, which opens to provide access to the interior of the machine. Typically, the main door 8 and/or any other portals which provide access to the interior of the machine utilize a locking mechanism of some sort as a security feature to limit access to the interior of the gaming machine. Attached to the main door are player-input switches or buttons 32, a coin acceptor 28, and a bill validator 30, a coin tray 38, a belly glass 40, and a monitor mask 42. Viewable through the main door is a video display monitor 34 and an information panel 36. The display monitor 34 will typically be a cathode ray tube, high resolution flat-panel LCD, or other conventional electronically controlled video monitor. Further, the video display monitor 34 may include a touch screen. The touch screen may respond to inputs made by a player touching certain portions of the screen. The information panel 36 is a back-lit, silk screened glass panel with lettering to indicate general game information including, for example, the number of coins played. The bill validator 30, player-input switches 32, video display monitor 34, and information panel are devices used to play a game on the game machine 2. The devices are controlled by circuitry (not shown) housed inside the main cabinet 4 of the machine 2. Many possible games, including traditional slot games, video slot games, video poker, keno, and lottery, may be provided with gaming machines of this invention.

The gaming machine 2 includes a top box 6, which sits on top of the main cabinet 4. The top box 6 houses a number of devices, which may be used to add features to a game being played on the gaming machine 2, including speakers 10, 12, 14, a glass panel with display lamps 16, a ticket printer 18 which prints bar-coded tickets 20, a key pad 22 for entering player tracking information, a florescent display 24 for displaying player tracking information, a card reader 26 for entering a magnetic striped card or a smart card containing player tracking information, and a video display screen 45. Further, the top box 6 may house different or additional devices than shown in the FIG. 1. For example, the top box may contain a bonus or prize reel which may be used to add bonus features to the game being played on the gaming machine. During a game, these devices are controlled, in part, by circuitry (not shown) housed within the main cabinet 4 of the machine 2. The top box 6 is designed to be removable from the machine 2. Typically, the top box 6 is replaced to repair a device within the top box 6 or to install a new top box 6 with a different set of devices and game features.

Understand that gaming machine 2 is but one example from a wide range of gaming machine designs on which the present invention may be implemented. For example, not all suitable gaming machines have top boxes or player tracking features. Further, some gaming machines have only a single game display—mechanical or video, while others are designed for bar tables and have displays that face upwards. As another example, a game may be generated in on a host computer and may be displayed on a remote terminal or a remote gaming device. The remote gaming device may be connected to the host computer via a network of some type such as a local area network, a wide area network, an intranet or the Internet. The remote gaming device may be a portable gaming device such as but not limited to a cell phone, a personal digital assistant, and a wireless game player. Thus, those of skill in the art will understand that the present invention, as described below, can be deployed on most any gaming machine now available or hereafter developed.

Images rendered from 3-D gaming environments may be displayed on the display of the gaming machines, such as 34 or 45, and/or on portable gaming devices that are used to play a game of chance. Further a gaming machine or server may include gaming logic for commanding a remote gaming device to render an image from a virtual camera in a 3-D gaming environments stored on the remote gaming device and to display the rendered image on a display located on the remote gaming device. Details of 3-D rendering methods and apparatus that may be used with the present invention are described co-pending U.S. application Ser. No. 09/927,901, filed Aug. 9, 2001 and titled, "Virtual Cameras and 3-D Gaming Environments in a Gaming Machine," which is incorporated herein in its entirety and for all purposes.

Some preferred gaming machines of the present assignee are implemented with special features and/or additional circuitry that differentiates them from general-purpose computers (e.g., desktop PC's and laptops). Gaming machines are highly regulated to ensure fairness and, in many cases, gaming machines are operable to dispense monetary awards of multiple millions of dollars. Therefore, to satisfy security and regulatory requirements in a gaming environment, hardware and software architectures may be implemented in gaming machines that differ significantly from those of general-purpose computers. A description of gaming machines relative to general-purpose computing machines and some examples of the additional (or different) components and features found in gaming machines are described below.

At first glance, one might think that adapting PC technologies to the gaming industry would be a simple proposition because both PCs and gaming machines employ microprocessors that control a variety of devices. However, because of such reasons as 1) the regulatory requirements that are placed upon gaming machines, 2) the harsh environment in which gaming machines operate, 3) security requirements and 4) fault tolerance requirements, adapting PC technologies to a gaming machine can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in a gaming machine because in a gaming machine these faults can lead to a direct loss of funds from the gaming machine, such as stolen cash or loss of revenue when the gaming machine is not operating properly.

For the purposes of illustration, a few differences between PC systems and gaming systems will be described. A first difference between gaming machines and common PC based computers systems is that gaming machines are designed to be state-based systems. In a state-based system, the system stores and maintains its current state in a non-volatile memory, such that, in the event of a power failure or other malfunction the gaming machine will return to its current state when the power is restored. For instance, if a player was shown an award for a game of chance and, before the award could be provided to the player the power failed, the gaming machine, upon the restoration of power, would return to the state where the award is indicated. As anyone who has used a PC, knows, PCs are not state machines and a majority of data is usually lost when a malfunction occurs. This requirement affects the software and hardware design on a gaming machine.

A second important difference between gaming machines and common PC based computer systems is that for regulation purposes, the software on the gaming machine used to generate the game of chance and operate the gaming machine has been designed to be static and monolithic to prevent cheating by the operator of gaming machine. For instance, one solution that has been employed in the gaming industry to prevent cheating and satisfy regulatory requirements has been to manufacture a gaming machine that can use a proprietary processor running instructions to generate the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used by the master gaming controller to operate a device during generation of the game of chance can require a new EPROM to be burnt, approved by the gaming jurisdiction and reinstalled on the gaming machine in the presence of a gaming regulator. Regardless of whether the EPROM solution is used, to gain approval in most gaming jurisdictions, a gaming machine must demonstrate sufficient safeguards that prevent an operator or player of a gaming machine from manipulating hardware and software in a manner that gives them an unfair and some cases an illegal advantage. The gaming machine should have a means to determine if the code it will execute is valid. If the code is not valid, the gaming machine must have a means to prevent the code from being executed. The code validation requirements in the gaming industry affect both hardware and software designs on gaming machines.

A third important difference between gaming machines and common PC based computer systems is the number and kinds of peripheral devices used on a gaming machine are not as great as on PC based computer systems. Traditionally, in the gaming industry, gaming machines have been relatively simple in the sense that the number of peripheral devices and the number of functions the gaming machine has been limited. Further, in operation, the functionality of gaming machines were relatively constant once the gaming machine was deployed, i.e., new peripherals devices and new gaming software were infrequently added to the gaming machine. This differs from a PC where users will go out and buy different combinations of devices and software from different manufacturers and connect them to a PC to suit their needs depending on a desired application. Therefore, the types of devices connected to a PC may vary greatly from user to user depending in their individual requirements and may vary significantly over time.

Although the variety of devices available for a PC may be greater than on a gaming machine, gaming machines still have unique device requirements that differ from a PC, such as device security requirements not usually addressed by PCs. For instance, monetary devices, such as coin dispensers, bill validators and ticket printers and computing devices that are used to govern the input and output of cash to a gaming machine have security requirements that are not typically addressed in PCs. Therefore, many PC techniques and methods developed to facilitate device connectivity and device compatibility do not address the emphasis placed on security in the gaming industry.

To address some of the issues described above, a number of hardware/software components and architectures are utilized in gaming machines that are not typically found in general purpose computing devices, such as PCs. These hardware/software components and architectures, as described below in more detail, include but are not limited to watchdog timers, voltage monitoring systems, state-based software architecture and supporting hardware, specialized communication interfaces, security monitoring and trusted memory.

A watchdog timer is normally used in IGT gaming machines to provide a software failure detection mechanism. In a normally operating system, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits contain a loadable timeout counter register to allow the operating software to set the timeout interval within a certain range of time. A differentiating feature of the some preferred circuits is that the operating software cannot completely disable the function of the watchdog timer. In other words, the watchdog timer always functions from the time power is applied to the board.

IGT gaming computer platforms preferably use several power supply voltages to operate portions of the computer circuitry. These can be generated in a central power supply or locally on the computer board. If any of these voltages falls out of the tolerance limits of the circuitry they power, unpredictable operation of the computer may result. Though most modern general-purpose computers include voltage monitoring circuitry, these types of circuits only report voltage status to the operating software. Out of tolerance voltages can cause software malfunction, creating a potential uncontrolled condition in the gaming computer. Gaming machines of the present assignee typically have power supplies with tighter voltage margins than that required by the operating circuitry. In addition, the voltage monitoring circuitry implemented in IGT gaming computers typically has two thresholds of control. The first threshold generates a software event that can be detected by the operating software and an error condition generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the computer.

The standard method of operation for IGT slot machine game software is to use a state machine. Each function of the game (bet, play, result, etc.) is defined as a state. When a game moves from one state to another, critical data regarding the game software is stored in a custom non-volatile memory subsystem. In addition, game history information regarding previous games played, amounts wagered, and so forth also should be stored in a non-volatile memory device. This feature allows the game to recover operation to the current state of play in the event of a malfunction, loss of power, etc. This is critical to ensure the player's wager and credits are preserved. Typically, battery backed RAM devices are used to preserve this critical data. These memory devices are not used in typical general-purpose computers.

IGT gaming computers normally contain additional interfaces, including serial interfaces, to connect to specific subsystems internal and external to the slot machine. The serial devices may have electrical interface requirements that differ from the "standard" EIA 232 serial interfaces provided by general-purpose computers. These interfaces may include EIA 485, EIA 422, Fiber Optic Serial, optically coupled serial interfaces, current loop style serial interfaces, etc. In addition, to conserve serial interfaces internally in the slot machine, serial devices may be connected in a shared, daisy-chain fashion where multiple peripheral devices are connected to a single serial channel.

IGT gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this.

Security monitoring circuits detect intrusion into an IGT gaming machine by monitoring security switches attached to access doors in the slot machine cabinet. Preferably, access violations result in suspension of game play and can trigger additional security operations to preserve the current state of game play. These circuits also function when power is off by use of a battery backup. In power-off operation, these circuits continue to monitor the access doors of the slot machine. When power is restored, the gaming machine can determine whether any security violations occurred while power was off, e.g., via software for reading status registers. This can trigger event log entries and further data authentication operations by the slot machine software.

Trusted memory devices are preferably included in an IGT gaming machine computer to ensure the authenticity of the software that may be stored on less secure memory subsystems, such as mass storage devices. Trusted memory devices and controlling circuitry are typically designed to not allow modification of the code and data stored in the memory device while the memory device is installed in the slot machine. The code and data stored in these devices may include authentication algorithms, random number generators, authentication keys, operating system kernels, etc. The purpose of these trusted memory devices is to provide gaming regulatory authorities a root trusted authority within the computing environment of the slot machine that can be tracked and verified as original. This may be accomplished via removal of the trusted memory device from the slot machine computer and verification of the secure memory device contents is a separate third party verification device. Once the trusted memory device is verified as authentic, and based on the approval of the verification algorithms contained in the trusted device, the gaming machine is allowed to verify the authenticity of additional code and data that may be located in the gaming computer assembly, such as code and data stored on hard disk drives.

Mass storage devices used in a general purpose computer typically allow code and data to be read from and written to the mass storage device. In a gaming machine environment, modification of the gaming code stored on a mass storage device is strictly controlled and would only be allowed under specific maintenance type events with electronic and physical enablers required. Though this level of security could be provided by software, IGT gaming computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present.

Returning to the example of FIG. 1, when a user wishes to play the gaming machine 2, he or she inserts cash or a credit of indicia through the coin acceptor 28 or bill validator 30. At the start of the game, the player may enter playing tracking information using the card reader 26, the keypad 22, and the florescent display 24. Further, other game preferences of the player playing the game may be read from a card inserted into the card reader or via another input mechanism coupled to the gaming machine. During the game, the player views game information using the video display 34. Other game and prize information may also be displayed in the video display screen 45 located in the top box.

During the course of a game, a player may be required to make a number of decisions, which affect the outcome of the game. For example, a player may vary their wager on a particular game, select a prize for a particular game, or make game decisions which affect the outcome of a particular game. The player may make these choices using the player-input switches 32, the video display screen 34 or using some other device which enables a player to input information into the gaming machine.

During certain game events, the gaming machine 2 may display visual and auditory effects that can be perceived by the player. These effects add to the excitement of a game, which makes a player more likely to continue playing. Auditory effects include various sounds that are projected by the speakers 10, 12, 14. Visual effects include flashing lights, strobing lights or other patterns displayed from lights on the gaming machine 2 including lights behind the front glass 16 on the top box 6 or from lights behind the belly glass 40. After the player has completed a game, the player may receive game tokens from the coin tray 38 or the ticket 20 from the printer 18, which may be used for further games or to redeem a prize. Further, the player may receive a ticket 20 for food, merchandise, or games from the printer 18.

Figure 2:
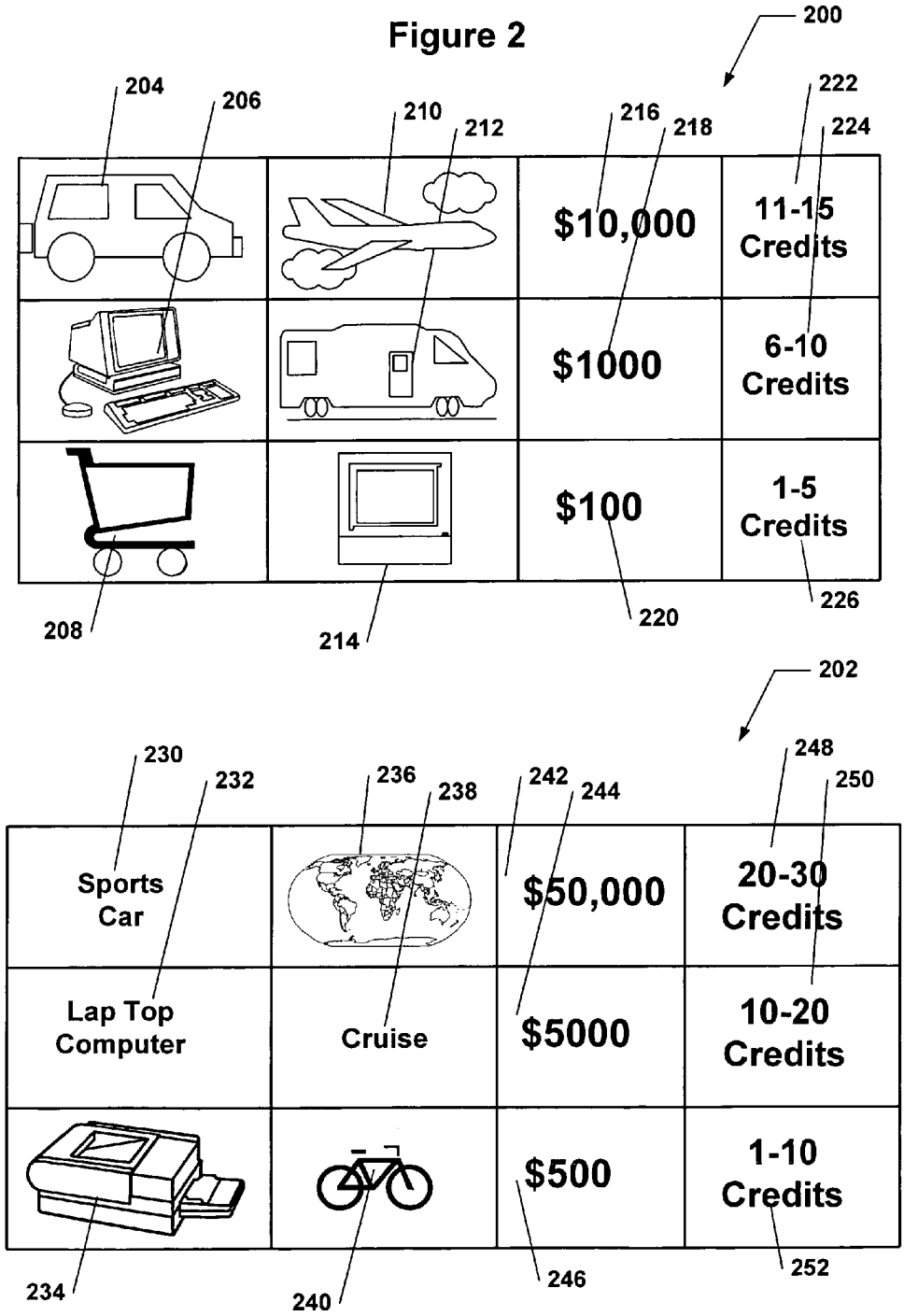
FIG. 2 is a block diagram depicting examples of prizes in a tabular prize display format.

FIG. 2 is a block diagram depicting examples of prizes in a tabular prize display format. A prize selection table 200 is a list of prizes displayed in a tabular format. A second prize selection table 202 shows an alternative list of prizes. Typically only a single prize selection table will be displayed for a single gaming machine prior to any play.

Each of the prize selection tables 200 and 202 contains a number of a prizes which a player may select as an award or pay-out when a certain outcome occurs during the course of a game being played on a gaming machine. For example, a player may select a prize, which may be won when a jackpot or maximum pay-out occurs during a slot game, video poker game, keno game or lottery game. Using one of the prize selection tables 200 or 202, a player may select prizes when an initiating a game on the gaming machine. One or more prize selections may be made for a particular game on the gaming machine including 1) selecting an individual prize for a particular game outcome including a jackpot or some other game outcome, 2) selecting a table containing a series of prizes corresponding to a number of game outcomes, or 3) selecting multiple prizes corresponding to multiple game outcomes.

The prize selection tables 200 and 202 may be presented to a player using a number of display methods including using a video display screen on the gaming machine, using a printed copy displayed on or near the gaming machine, using a backlit glass panel attached to the gaming machine, using a display screen viewable by players playing a game on a gaming machine but not attached to the gaming machine, using a carousel displaying a number of actual prizes, or using a bonus reel with graphical or textual representations of prizes. One or more combinations of prize display methods may be used by a player for prize selection. For example, the prize selection tables 200 and 202 might be displayed on a video display screen on the gaming machine, on a printed sign on or near the gaming machine, or on a silk screen glass display panel incorporated into the main cabinet of the gaming machine. The display format is not limited to the format of prize selections tables 200 and 202. The prize selection table may be presented in any manner that allows a player to select from a list of one or more prizes. Further, prizes may be listed in a graphical or textual manner.

Usually, the prize selection process begins before a game play has been initiated on the gaming machine. A player viewing a prize selection table, 200 or 202, displayed on or near the gaming machine using a prize display method some type may select one or more prizes connected to one or more game outcomes, including a jackpot for a slot machine or a royal flush for a video poker machine, from a list of prizes presented. For example, a player might chose as a prize for a jackpot from the group consisting of a compact car 204, a computer 206, a shopping spree 208, a plane trip 210, a camping trip 212, a television 214 or cash 216, 218, 220 from prize table 200. As another example, a player may chose as a prize for a jackpot a sports car 230, a lap-top computer 232, a computer printer 234, a trip around the world 236, a cruise 238, a bicycle 240 or cash 242, 244, 246. In the prize selection tables 200 and 202, the prizes are presented both graphically and textually. For example, the airplane trip 210 is represented graphically by a picture of a plane and clouds while the sports car 230 is represented textually. Obviously, the designer may chose to display the individual prizes in any manner that he or she chooses.

The prizes or cash amounts are not always limited to the individual prizes and cash amounts presented in prize selection table 200 and prize selection table 202. The prize tables may combine many different combinations of prizes, rewards and cash amounts that may encourage game play on a gaming machine and add excitement to a game being played on the gaming machine. For example, prize selection tables may present prizes based on a theme which may interest a player including vacations, cars, computers, motorcycles or other merchandise. As another example, a player may be able to select other awards or benefits including airline miles on a particular airline for a game outcome on a gaming machine. Still further, the different game outcomes might correspond to different available prizes. For example, in a video poker game, a royal flush might award a sports car, four of a kind might award a motorcycle, and a full house might award a bicycle.

The type of prize, cash amount or reward a player may select from a prize selection table including prize selection table 200 and prize selection table 202 may be linked to the wager amount for the game that has been initiated on the gaming machine. For example, in prize selection table 200, the shopping spree 208, the television 214, or the cash 220 may be selected when a wager of 1-5 coins or "credits" 226 has been made prior to the initiation of the game on the gaming machine. The computer 206, the camping trip 212, or the cash 218 may be selected when a wager of 6-10 coins or "credits" 224 has been made. The compact car 204, the plane trip 210 or cash 216 may be selected when a wager of 11-15 coins or credits 222 has been made.

As suggested by this discussion, the amount of the wager needed to select one or more prizes presented in a prize selection table or some other prize display format may be linked to the value of the prize. As a further example, in prize selection table 202, a wager of "20-30 credits" 248 may allow a prize to be selected from the group consisting of the sports car 230, the around the world trip 236 or the cash 242. A wager of "10-20 credits" 250 may allow a prize to be selected from the group consisting of the lap top computer 232, the cruise 238, or the cash 244. A wager of "1-10 credits" 252 may allow a player to select from the group of prizes consisting of the computer printer 234, the bicycle 240, or the cash 246. In this example, the prize values of the sports car 230, the around the world trip 236 or the cash 242 are greater than the prize values of the lap top computer 232, the cruise 238, or the cash 244. Further, the prize values of the lap top computer 232, the cruise 238, or the cash 244 are greater than the prize values of the computer printer 234, the bicycle 240, or the cash 246. Thus, in the prize selection table 202, the value of the prizes that may be selected when a particular wager is made increases as the wager amount increases. Generally, the value of the prizes available for selection will increase as the value of the wager amount increases. Of course, some embodiments of this invention do not require that a player play more coins or credits to pursue the most valuable prizes. The multi-range examples of FIG. 2 are presented for the sake of illustration only.

In another embodiment of this invention, the number of prizes that may be selected increases as the amount of the wager is increased. For example, in the prize selection table 202, when a player wagers 1-10 credits, a player may select one prize from the "1-10" credits row 252 including the printer 234, the bike, or the cash 246. When a player wagers 10-20 credits, a player may select two prizes, one prize from the "10-20" credits row 250 including the cash 244, the cruise 238 and the lap-top computer 232 and one prize from the "1-10" credits row 252. Thus, after wagering 10-20 credits, a player may select the cruise 238 and the cash 246 as prizes. When a player wagers 20-30 credits, a player may select three prizes, one prize from the "20-30" credits row 248 including the sports car 230, the world trip 236, and the cash 242, one prize from the "10-20" credits row 250, and select one prize from the "1-10" credits row 252. Thus, after wagering 20-30 credits, a player may select the world trip 236, the cash 244, and the bike 240. The multi-range examples of FIG. 2 are presented for the sake of illustration only.

The odds of winning a prize selected from the prize selection table or another list of prizes displayed in an alternate display format may vary as a function of the prize selected. For example, in prize selection table 202, the odds of winning a bicycle 240 may be greater than the odds of winning a sports car 230. Thus, the prize selection process may allow a player to select a prize which has greater or lower probability of occurring for a particular game outcome of a game played by the player on the gaming machine. The odds of winning a particular prize typically are not chosen by the player. In a prize selection table or in a list of prizes displayed in some other display format, the odds of winning certain prizes may be presented in a relative manner so that a player can ascertain whether the probability of winning a particular prize is higher or lower relative to another prize. The odds of each outcome of a game are usually stored in the gaming machine in the form of a "pay table." When the pay table of a game is adjustable (e.g. slot games) the odds of winning a particular prize will typically decrease as the value of the prize increases.

Figure 3:
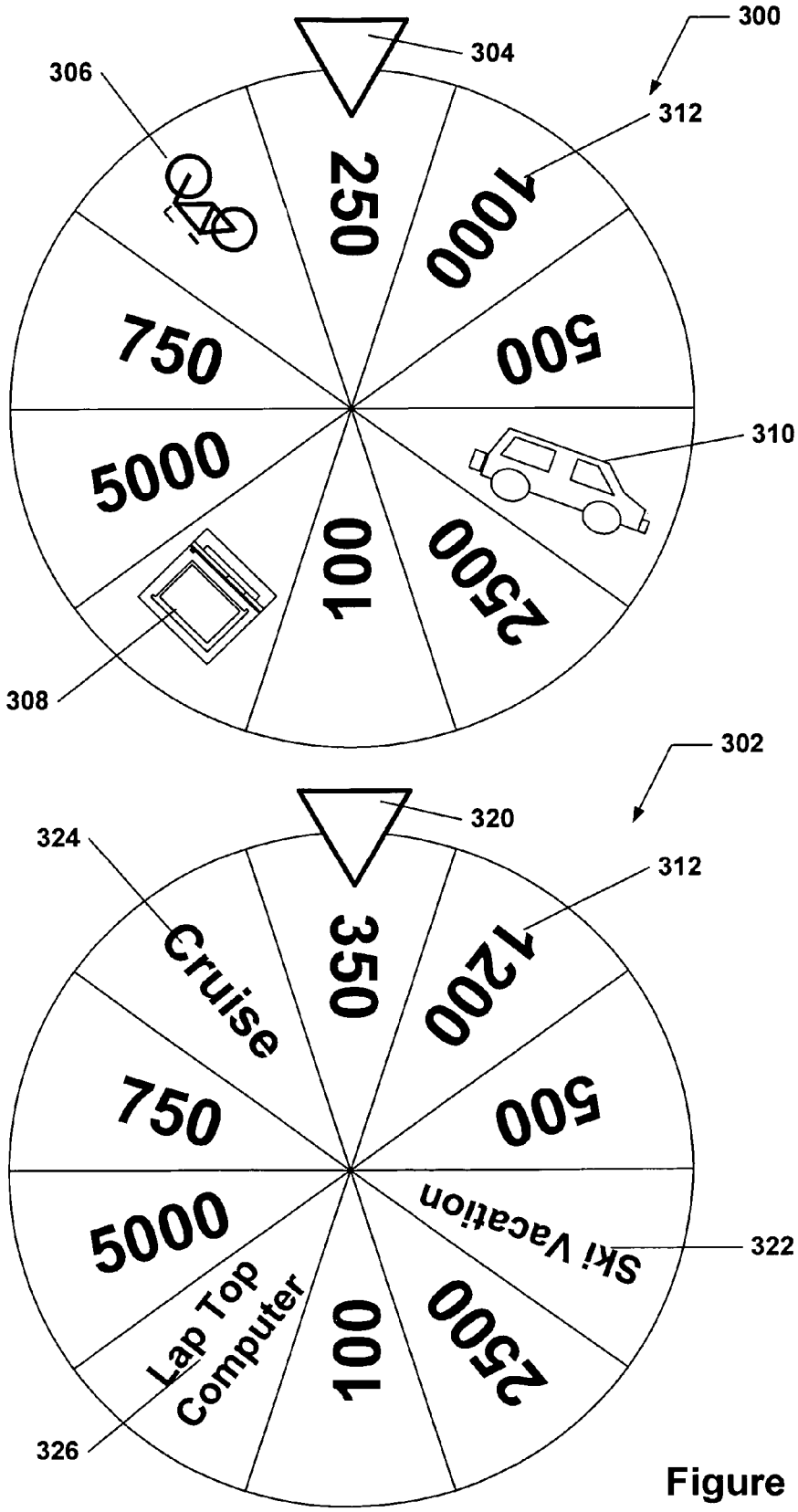
FIG. 3 is a block diagram depicting examples of prizes in a circular or "wheel" prize display format.

FIG. 3 is a diagram depicting examples of prizes in a circular or "wheel" shaped prize display format. The circular prize selection tables 300 and 302 are divided into wedges such that different prizes may be displayed in each wedge. The circular prize selection tables 300 and 302 may be displayed using a number of display methods including a including using a video display screen on the gaming machine, using a printed copy displayed on or near the gaming machine, using a back-lit glass panel attached to the gaming machine, using a display screen viewable by players playing a game on a gaming machine but not attached to the gaming machine, or using a bonus reel with graphical or textual representations of prizes.

The circular prize selection tables 300 and 302 are incorporated as part of a mechanical or video bonus reel in one embodiment of the present invention. A mechanical bonus reel might be comprised of a wheel with a circular prize selection table 300 or 302 mounted on the wheel such that the prizes are viewable by a player playing a game on the gaming machine. A player may select a prize on the circular prize selection tables 300 and 302 by inputting commands into the gaming machine in some manner that cause a motor or some other device connected to the mechanical bonus reel to rotate to a certain a position. Alternatively, the player may manually adjust the wheel position to select the desired prize. When the wheel is rotated to a position under the prize selector 304, a player has selected the prize contained within the wedge under the prize selector 304. For example, by inputting commands that rotates the bonus reel, the player might select the bicycle 306, the television 308, the car 310 or the cash 312 to correspond to the outcome of a game event when the game is played. As described above in reference to FIG. 2, the prize selected from the prize selection table may be linked to the outcome of a game event including a jackpot for a slot machine or a royal flush for a video poker game. Further, the prizes available for selection from the circular prize selection tables may be limited by the amount of the wager for a particular game. Also, the probability of winning a particular prize in the prize the selection table may be different for different prizes.

For a mechanical implementation of the circular prize selection table as part of a prize reel for one embodiment of the present invention, the available prize selection might be altered by replacing individual wedge pieces within the circular prize selection table. For example, the wedge containing a bicycle prize 306 in the circular prize selection table 300 could be replaced with a wedge containing a cruise prize 324. As another example, the entire wheel containing the circular prize selection table 300 could be replaced with another entire bonus wheel containing the circular prize selection table 302. The prizes on a wedge can be represented in either textual formats or graphical formats. For example, a car 310 in the circular prize selection table 304 is presented graphically while the cruise in the circular prize selection table 306 is presented textually.

In one embodiment of the invention, the circular prize selection table might be implemented for presentation on a video display on or near the gaming machine. For example, a player might select a prize from the circular prize selection table 302 by inputting commands to the gaming machine that rotate a video presentation of the circular prize selection table 302 under the prize selector 320. Thus, a player might select a prize from the group consisting of the cruise trip 324, the ski vacation 322, the lap top computer 326 or the cash 322.

In another embodiment, the gaming machine may be operable to allow a player to initiate a "spin" of the prize selection table 302. The gaming machine may determine a final position of the prize selection table 302 and display the table 302 rotating. The final position of the prize selection table 302 may determine the prize that is selected.

A player might input commands into the gaming machine to rotate the bonus wheel and select a prize from the circular prize selection table 302 using one or more input devices on the gaming machine including a touch screen device, a mouse, a touch pad, joystick, a microphone connected to voice recognition technology or input buttons. In another embodiment, the player may be able to select a portion of the wheel displaying the prize using a touch screen sensor coupled to the display. For example, when the prize wheel is displayed on a touch screen video display, the gaming machine may be operable to receive a selection of a prize displayed on the wheel via the touch screen.

Figure 4:
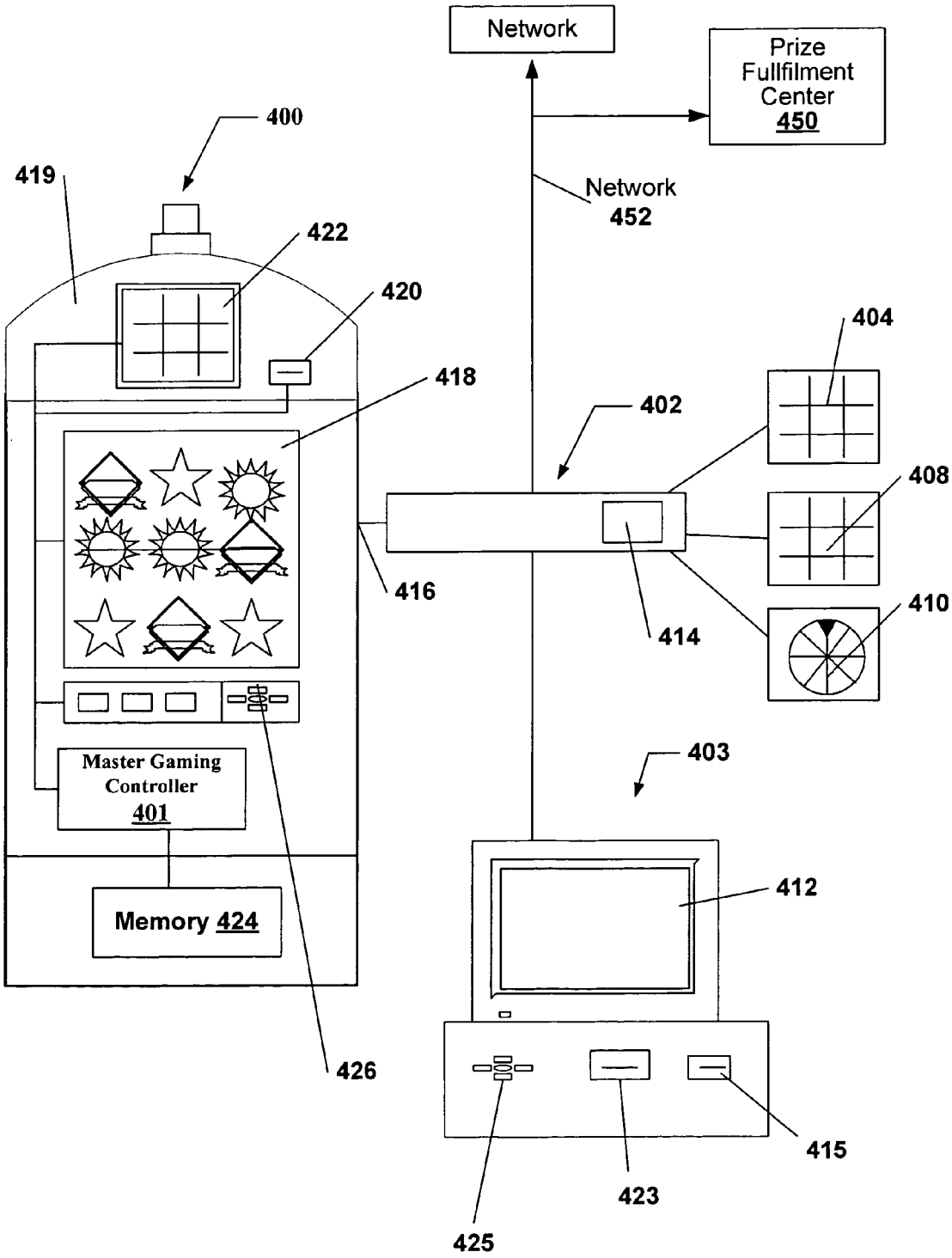
FIG. 4 is a block diagram depicting a gaming machine and a prize server.

FIG. 4 is a block diagram depicting a gaming machine and a prize server. The depicted prize server 402 includes a memory storage device 414 storing a database of prizes and a means of accessing and communicating prize information. The prize server 402 might be located within the gaming machine 400 or in a location physically separate from the gaming machine. A prize server typically serves groups of prizes to various gaming machines in a casino. The casino or a user may select a group of prizes to be made available for selection specific machines. The prizes stored for serving may be grouped by theme, relative value, diversity, and the like. Three different prize groups 404, 408, and 410 are depicted as being stored in device 414 (and thereby made available for serving to individual gaming machines).

As described with reference to FIGS. 2 and 3, the list of prizes available for selection from the prize server 402 may be displayed in various formats including graphical lists, textual lists or combination of both graphic and textual lists. For example, in one embodiment of the present invention, the prizes are presented in the display format of prize selection table 404 where the prize selection table is organized as a square grid as described above with reference to FIG. 2. Prize information from the prize server 402 including the prize selection table 404 may be displayed on a video display screen 412 or any other display device that is in communication with the prize server. In another embodiment of the present invention, the prize display format 410 is organized as a circular grid as described above with reference to FIG. 3 and may be displayed on the video display screen 412. Note that actual format of the displayed prize groups may be controlled by the individual gaming machines, rather than the prize server. In such cases, the server merely provides lists of prizes and associated values. In either case, the gaming machine will typically supply the appropriate pay tables for the individual prizes that may be selected.

As mentioned, the prizes stored in the memory storage device 414 of the prize server 402 may be presented or sorted according to various themes or combinations of themes. For example, the prize selection table 404 might contain a list of cruises that are presented according to the value of the prizes, the prize selection table 408 might contain a list of cars that are presented according to the manufacturer of the car and the circular prize selection table 410 might contain a list of vacations that are presented according to the location. The prizes available from the prize server might be changed by modifying the information stored within the memory storage device 414. For example, a list of prizes might be stored on a CD-ROM which is readable by the prize server 402. The contents of such CD-ROM or other portable storage device might be temporarily or permanently stored in the memory storage device 414 or downloaded from another secured server via a network. The available prizes on the prize server 402 might be changed by inserting a new CD-ROM into the memory storage device 414. In other embodiments, lists of prizes might be stored on an EEPROM, a non-volatile memory, a DVD, a floppy disk, a hard drive or some other means of information storage which may be modified in some manner to change the available prizes.

The prize selection process could be carried out in a number of ways. In a preferred embodiment, the casino or gaming machine vendor or service organization utilizes a protocol that downloads selected groups of prizes from the server 402 to the gaming machine 400. In a network environment, the server could be controlled through a terminal 403 (e.g., a PC). In some cases, terminal 403 is provided in a different location from the gaming machine but connected to the prize server 402 which may be located within the gaming machine or in a location physically separate from the gaming machine. Lists of prizes are displayed, possibly in the same display formats that they will be presented to the user at the gaming machines. For example, available groups of prizes may be displayed on terminal 403 as prize selection tables, 404, 408 and 410. The network operator selects desired groups of prizes and associated gaming machines using suitable user interfaces such as keyboards, mice, touch screens, and the like.

In an alternative embodiment of the present invention, a player has direct access to terminal 403, which may be configured as a "prize kiosk." The prize groups may be viewed by the player on a touch screen 412. Also, the prizes could be viewed on a video display screen without touch screen capabilities. The different prizes presented are viewed, searched and selected using the touch screen 412, prize selection inputs 425 or combinations of both the touch screen and the prize selection inputs. When a player has chosen one or more prizes or combinations of prizes, the prize information may be stored on a magnetic card or smart card inserted into the card reader 415 or a printed prize sheet from the printer 423. Other output mechanisms may be used to output prize information to a storage device including an optical card reader, a smart card reader, a personal digital assistant or a mechanism for electronically transferring data to a player's pre-existing account such as a connection to remote account server.

To play for one or more of the selected prizes, a player presents the instrument, such as but not limited to a printed media (e.g., a printed ticket or electronic scan sheet), a magnetic striped card, a smart card, a cell phone, a personal digital assistant, a portable electronic device or an RFID enabled device, storing the prize selection information in a manner that allows the information stored on the instrument to be read. For instance, the player may insert the magnetic card or smart card containing the prize information into the card reader 420 on the gaming machine 400 or input prize information into the gaming machine using the prize selection inputs 426. As another example, the player may place an RFID enabled device storing prize information near a RFID reader on the gaming machine. Details of RFID enabled instruments and bar-coded instruments that may be used with the present invention are described in co-pending U.S. application Ser. No. 10/214,936, by Kaminkow, et al., filed Aug. 6, 2002 and titled, "Flexible Loyalty Points Programs," which is incorporated herein by reference and for all purposes.

The prize information containing the selected prizes might be read and displayed on the display screen 422 or some other display device on the gaming machine. When the player initiates a game, the gaming machine selects the appropriate pay table for the prize or prizes selected and presents a game outcome to the player in the display area 418. The pay tables corresponding to different prizes and may be stored in a memory location 424 residing within the gaming machine 400. The may also be configured on a master gaming controller of the gaming machine. When a specific outcome of a game occurs corresponding to a pay-out of the selected prize, the player wins the selected prize. An advantage of acquiring prize information on a terminal separate from the gaming machine is that a large number of prizes may be searched without using valuable game playing time searching for a gaming machine having the prizes desired by a player.

In another embodiment of the present invention, a player selects prizes from a display terminal connected directly to the gaming machine. For example, prizes available for selection might be displayed on the display screen 422 located within the top box 419 or on the display screen 418 located on the main cabinet of the gaming machine 400. A list of available prizes or prize groups might be obtained from the prize server 402 which may be located within the gaming machine 400 or may be physically separate from the gaming machine. After initiating a game by inputting a wager into the gaming machine 400, a player might pre-select a prize from the list of prizes available and begin game play. As described above, when a game play is initiated by the player, the gaming machine selects the appropriate pay table for the prize or prizes selected and presents a game outcome to the player in the display area 418. As mentioned, the pay tables corresponding to different prizes and may be stored in a memory 424 or configured on the master gaming controller of gaming machine 400. When a specific outcome of a game occurs corresponding to a pay-out of the selected prize, the player wins the selected prize.

In one embodiment, the prize server 402 may be connected to a prize fulfillment center 450. Thus, when a player wins a specific prize on the gaming machine 400, the prize information is sent from the gaming machine to the prize server 402. Then, the prize information is sent over a network 452 to the prize fulfillment center 450. The purpose of the prize fulfillment center is to acquire and transfer the prize won by the player to the player. For example, when a player wins a computer, the prize fulfillment center might order the computer from a vendor and have it shipped to the player's home address. As another example, the prize fulfillment center might send a request to a nearby warehouse and have the prize delivered to a location in the casino where the player can pick up the prize.

Figure 5:
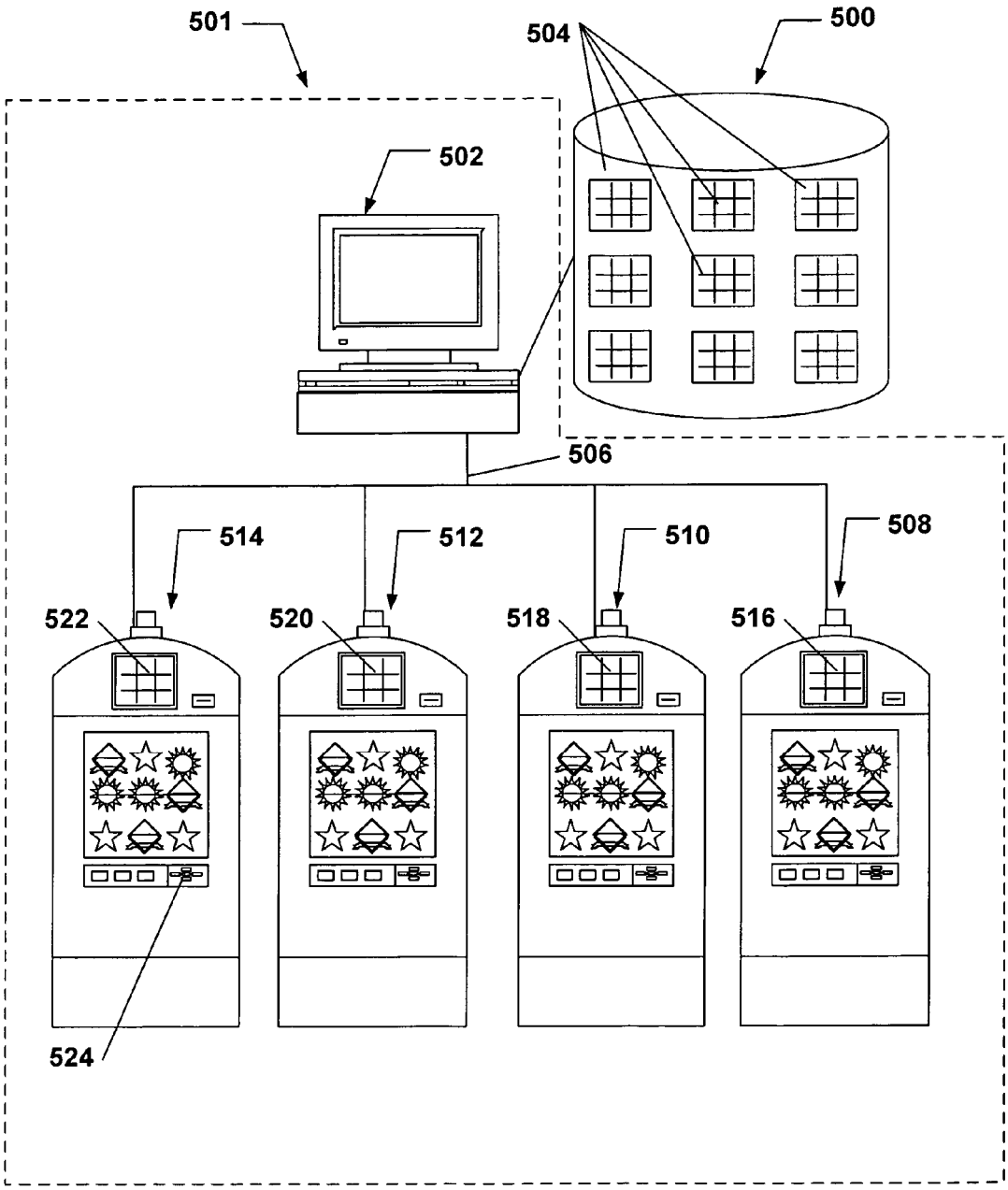
FIG. 5 is a block diagram depicting a group of gaming machines connected to a prize server in a prize distribution network for one embodiment of the present invention.

FIG. 5 is a block diagram depicting a group of gaming machines connected to a prize server in a prize distribution network for one embodiment of the present invention. The prize distribution network is comprised of a prize server connected to a plurality of gaming machines. In FIG. 5, a prize server 502 is connected to four gaming machines, 508, 510, 512, and 514, representative of a typically larger group. The network connection 506 between the prize server and the gaming machines may be implemented using a fiber optic link, copper wire (e.g., coaxial line), a wireless link or some other suitable connection means. Communication may take place via any suitable protocol or group of protocols such as USB, Ethernet, TCP/IP and the like. The depicted prize server 502 contains a database 500 containing lists of prizes. The list of prizes stored in the database may be accessible in various groupings. For example, the prizes may be stored and accessed in some manner corresponding to the prize selection tables 504 as described with reference to FIGS. 3 and 4. Further, the lists of prizes stored in the database 500 may be stored and accessed in groups according to various themes including vacations, merchandise, or value.

With a prize distribution network 501, prize groups available on each gaming machine might be replaced by downloading prize information from the prize server 502 to the various individual gaming machines in the prize distribution network. One goal of a network system such as that depicted in FIG. 5 is to allow a casino or other entity to vary the distribution of available prizes over its various installed gaming machines. To present a "new look," a casino may download prizes from the prize server 502 so that the gaming machine 508 has car prizes available for prize selection which are displayed on the video display 516, the gaming machine 510 has vacation prizes available for prize selection which are displayed on the video display 518, the gaming machine 512 has computer prizes available for prize selection which are displayed on the video display 520, and the gaming machine 514 has ski prizes available for prize selection which are displayed on the video display 522. The list of prizes stored on each gaming machine is typically stored on prize server 502.

As described in reference to FIGS. 2, 3, 4, 5, a player desiring to play a game for a particular prize on a given gaming machine might select the prize by using prize selection inputs 524 located on the gaming machine. Depending on the popularity of a given a prize, the prizes available on the gaming machines in the prize distribution network 501 might be changed. For example, when the ski prizes available on gaming machine 514 are popular, ski prizes may be downloaded from the prize server 502 on the gaming machines 508, 510, and 512. As another example, when the car prizes available on gaming machine 508 are popular, car prizes may be downloaded from the prize server 501 to the gaming machines 510, 512 and 514. Typically, the types of prizes available on a particular gaming machine are determined by the operator of the gaming machine.

The redistribution of prizes on the gaming machines with a prize selection capability does not necessarily require a prize distribution network. For example, each gaming machine 508, 510, 512, 514, might contain a prize server with a CD-ROM, EEPROM, non-volatile RAM, DVD or some other memory storage device. The prize information is stored within the memory storage device. The prizes available on each gaming machine might be changed by inputting new prize information into the memory storage device or exchanging the memory storage device. As another example, each gaming machine might be connected to a top box with a prize selection display including a bonus reel. The prize distribution on various gaming machines might be changed be exchanging the top box on each gaming machine with a second top box displaying a different set of prizes than the first top box on the gaming machine.

FIGS. 6A and 6B are block diagrams depicting an example of a casino floor with a single fixed arrangement of gaming machines, but different prize group distributions across those gaming machines. The different distributions are programmed using a prize server network in one embodiment of the present invention. A prize server 602 is connected to a number of gaming machines via a prize distribution network 604, which may be part of a casino area network. The gaming machines, represented by square blocks, are located at various locations on a casino floor 601. For example, a gaming machine 622 is located near a door 624 which provides access to the casino floor 601. The gaming machine 622 is also near a prize carousel 620. The prize carousel 620 is typically a circular platform displaying one or more prizes. For example, a car, motorcycle, boat or other merchandise might be displayed on the carousel. The gaming machine 607 is located in the back corner of the casino floor 600. The prize server 602 is located in a separate room 603, which has limited access from the casino floor 601. A number of the gaming machines are displaying prizes. In FIG. 6A, the distribution of different prizes on the gaming machines is a casino floor prize plan 600. In this example, the gaming machine 607 is displaying prize "A" 606, the gaming machine 609 is displaying prize "D" 608, the gaming machine 611 is displaying prize "B" 610, the gaming machine 613 is displaying prize "E" 612, the gaming machine 615 is displaying prize "F" 614, the gaming machine 617 is displaying prize "C" 616, the gaming machine 619 is displaying prize "G" 618, and the gaming machine 622 is displaying prize "H" 622. The textual or graphical representations of the prizes may displayed on a video screens, touch screens, LCDs, or other display panels located on or near the gaming the gaming machine. For example, when prize "A" 606 is a car, a picture or movie of a car might be displayed on a video screen attached to the gaming machine 607 or on a video screen hanging above the gaming machine 607. The car prize might be won by a player playing a game on the gaming machine 607.

The casino floor prize plan 600 might be changed by downloading new prizes from the prize server to each gaming machine in communication with the prize server 602. After a communication link is established with the remote prize server 602, new prizes might be downloaded into gaming machines, which might be displayed on display mechanisms on or near each gaming machine. This process might be implemented by operators of the casino to increase traffic into the casino and to maximize game play on the gaming machines on the casino floor. For example, for a casino floor prize plan 630 shown in FIG. 6B, when the prize "A" on gaming machine 606 is very popular, the prize "A" 606 might be offered on gaming machine 623, which is close to the door 624, to draw game players into the casino. The changing of the prize offered on gaming machine 623 from prize "H" 622 in the casino floor plan 600 to prize "A" 606 in casino floor plan 630 might be accomplished by downloading the prize "A" information onto gaming machine 623 using the prize server 602. This process might be repeated to change the casino floor prize plan 630 from casino floor prize plan 600 where the gaming machine 607 is displaying prize "H" 622, the gaming machine 609 is displaying prize "C" 616, the gaming machine 611 is displaying prize "G" 618, the gaming machine 613 is displaying prize "F" 614, the gaming machine 615 is displaying prize "E" 612, the gaming machine 617 is displaying prize "D" 608, the gaming machine 619 is displaying prize "B" 610, and the gaming machine 623 is displaying prize "A" 606. An advantage of this prize server game playing methodology is that the location of prizes on the casino floor might be redistributed much faster than physically moving each of the gaming machines.

In another embodiment, the central prize server game playing methodology may be used to change the distribution of prizes on a casino floor without employing a remote prize server. When no central prize server is available, the prizes offered on a gaming machine may be changed by changing the prize information stored in each gaming machine. For example, the prize information and prizes offered on a gaming machine that reads a CD-ROM might be changed by changing the CD-ROM in the gaming machine. This is a rather tedious process. A central prize server as illustrated in FIGS. 6A and 6B can instead allow a casino to completely change the "look" of its floor by having an operator reconfigure the gaming machines without ever visiting them.

As part of the prize distribution network 602, the prize server 602 may be connected to a prize fulfillment center 650 via a network 652 as described with reference to FIG. 4. Thus, when a player wins a specific prize on one of the gaming machines, the prize information is sent from the gaming machine to the prize server 602 and over a network 652 to the prize fulfillment center 650. The purpose of the prize fulfillment center is to acquire and transfer the prize won by the player to the player. For example, when a player wins a computer, the prize fulfillment center might order the computer from a vendor and have it shipped to the player's home address. As another example, the prize fulfillment center might send a request to a nearby warehouse and have the prize delivered to a location in the casino where the player can pick up the prize.

Figure 7:
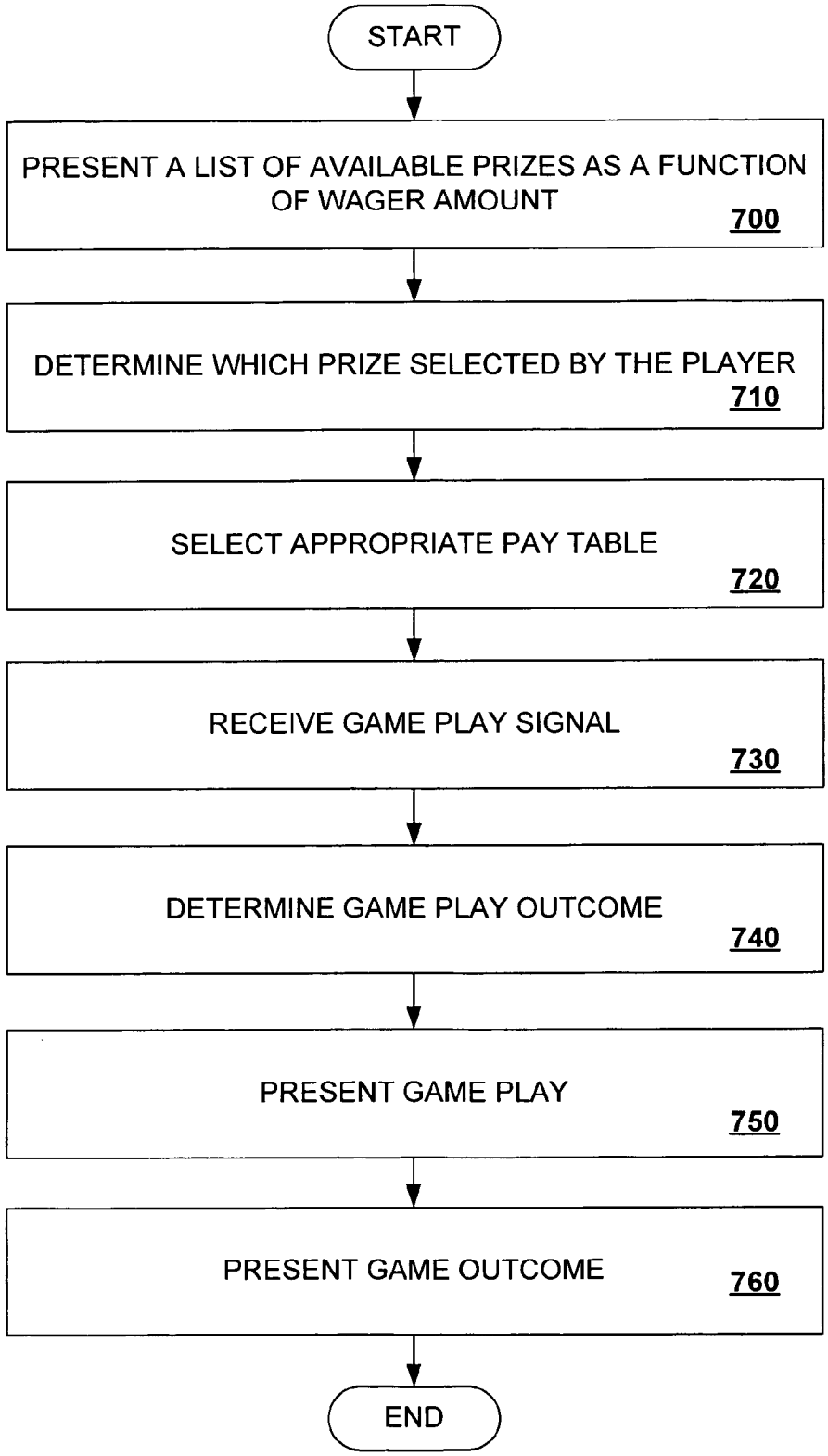
FIG. 7 is a flow chart depicting a name your prize, prize selection methodology on a gaming machine.

FIG. 7 is a flow chart depicting the name your prize, prize selection methodology on a gaming machine. In step 700, a list of available prizes on the gaming machine is presented. The list of prizes may be in a graphical or textual format and organized in some display format as described in reference to FIGS. 2 and 3. The prizes available for selection may be optionally a function of the amount of money wagered by the player. The list of prizes may include cash and non-cash prizes. The gaming machine may be operable to allow a player to select between two or more non-cash prizes. The non-cash prizes may be of a similar value or non-cash prizes may vary substantially in value relative to one another.

In step 710, after a player has selected a prize using an input method of some type, the gaming machine determines which prize was selected by the player. The prize selected by the player might be displayed on a display screen or a display mechanism of some type visible to the player. The player might select a prize using a touch screen, key pad, input buttons or some other input method to select a prize. The odds of winning a particular prize may be related to some feature of the prize. For example, the odds of winning a prize may decrease as the value of the prize increases.

In another embodiment, information regarding a selection of one or more prizes preferred by a game player may be downloaded from a remote gaming device. For example, preferred prizes previously selected by the player may be stored on a remote gaming device, such as a player tracking server. When a player tracking session is initiated on the gaming machine, information regarding these preferred or previously selected prizes may be downloaded to the gaming machine.

In yet another embodiment, information regarding a selection of one or more prizes preferred by a game player may be downloaded or transferred from an instrument or portable electronic device carried by the player. For example, the instrument may be a magnetic striped card, printed ticket or some other media designed to record prize selection information. Examples of a portable electronic device include but are not limited to a cell phone, personal digital assistant, smart card a memory stick or a portable hard-drive. The gaming machine may include one or more input mechanisms allowing the prize selection information to be transferred from the instrument or the portable electronic device to the gaming machine (e.g., a card reader, a ticket reader, a wireless interface or wired interface).

When the gaming machine receives the prize information from the remote gaming device, an instrument or a portable electronic device, the gaming machine may check to determine if the downloaded prize selections are compatible with the current configuration of the gaming machine. In some embodiments, particular prizes may only be offered on particular gaming machines. For example, certain prizes may be associated only with one type of game or a group of games. When the received prize selections are compatible with the current configuration of the gaming machine, the prize selections may be automatically input into the gaming machine without requiring additional player input. In one embodiment, after the prize selections are automatically entered, the gaming machine may request a confirmation from the player. For example, the gaming machine may generate and display a message such as "Hit the 'enter' button," if you wish to play a game for these prize selections.

In one embodiment of the present invention, a remote gaming device, such as a player tracking server may track and store records of a prize selections made by a player that have occurred during the play of many different games of chance over time. For example, during games played during multiple visits to a casino, prize selections made by a game player may be stored on the player tracking server. The prize selections may be used by the player tracking server to determine prizes related to the players previous selections that may be of interest to the player. The player tracking server may also use personal information gathered from the player such as an age, income, education level, profession, gender, marital status, personal preferences and a residence location to determine prize suggestions. These prize selection suggestions may be downloaded to the gaming machine from the remote gaming device along with previous prize selections made by the player.

The non-cash prizes that are available may change with time. For example, certain prizes may be out of stock or may no longer be made. As another example, a casino may wish 'move' a particular prizes. The prize suggestion feature may be used to suggest alternate prizes as substitutes when certain prizes are no longer available or to recommend a particular prize that a casino wishes to 'move.'

When the prize selection information received from the remote gaming device is not compatible with the prize selections received from the remote gaming device, the gaming machine may attempt to alter its configuration to accommodate the prize selections. For example, if the prize selections are associated with a particular game that is currently not being executed on the gaming machine, then the gaming may attempt to load the particular game associated with the prize or prize selections. To load the particular game, in some embodiments, the gaming machine may have to download additional gaming software from a remote gaming device or contact a remote gaming device that provides play of the desired game on a remote terminal.

In another example of the gaming machine adjusting its configuration to accommodate a prize selection, the prize selection(s) received from the remote gaming device may not be compatible with the current paytable on the gaming machine. To win a selected prize, the prize is associated with an outcome for a game of chance to be played on the gaming machine. The probabilities for each of the outcomes for the game of chance are described in the paytable. The value of the one or more of the selected prizes may require a probability of winning the prize to be adjusted in the paytable stored in the gaming machine. One methodology for adjusting probabilities in a paytable is described with respect to FIG. 8.

In another embodiment of the present invention, descriptors may be used to match a prize to an outcome for a game of chance. For example, each outcome for the game of change may be assigned one or more descriptors, such as a value or a range of values. The descriptors may be stored in the paytable. The descriptors, corresponding to the descriptors stored in the paytable, may also be assigned to each prize, such as but not limited to a "cash" value for a prize, a number that rates the prize or a text descriptor for the prize, such as "low," "medium," or "high." Prize selections received from a remote gaming device may include the descriptor information for the prize.

The descriptor information for the prize may be used to match the prize to a particular game outcome or multiple game outcomes stored in the paytable. When a match is found, the gaming machine may notify the player of the match. For example, the gaming machine may generate a message, such as "When outcome 'A' occurs, you win prize 'B'." Conditions may be attached to the match. For example, the match may require the player to wager a certain amount. Thus, the gaming machine may generate a message, such as, "When a wager of 'A' credits is made and outcome 'B' occurs, you win prize 'C'."

For a slot game, an outcome matched to a prize selection may be a combination of symbols. For a card game, it may be a particular combination of cards. For a Bingo game, the outcome may be a pattern on a bingo card. Of course, the present invention is not limited to these examples and a prize may be matched to many different types of games.

As described above, the gaming machine may be operable to suggest prizes or recommend prizes for selection. The suggestions or recommendations may include incentives provided by the casino to increase the likelihood of a player accepting a selection of a suggested prize. For instance, the casino may adjust a descriptor associated with a suggested prize that they wish to "move" so that the suggested prize can be matched to an outcome in the paytable with a higher probability occurring. The player may receive a message describing the incentive for the suggested prize, such as "For a limited time only, win prize 'A,' valued at 'B,' with only a wager of 'C'. There are only 'D' number of prize 'A's' left."

To add excitement to game play on a gaming machine, the probability of winning a selected prize may be adjusted periodically, such as by adjusting the descriptor information for a prize that is used to match the prize to game outcome(s) in the paytable. For example, when a bonus event occurs on a gaming machine, the descriptor information for a selected prize may be adjusted to increase a player's chance of winning the prize. The adjustment in the descriptor information may result in changing a condition associated with the outcome, such as but not limited to a minimum wager, or in changing the outcome or outcomes to which the selected prize is matched. For example, the adjustment in the descriptor information may result in assigning the selected prize to its current outcome and to one or more additional outcomes.

Returning to FIG. 7, after the prize selected by the player is determined, the gaming machine may select a pay-table containing the appropriate odds of winning the selected prize in step 720. For example, when a prize selection cannot be matched to an outcome to the paytable currently loaded on the gaming machine. The gaming machine may search for a paytable stored on the gaming machine that is compatible with the prize selection. In one embodiment, the gaming machine may include a memory storing a plurality of paytables. These paytables may be pre-approved for use on the gaming machine by a gaming jurisdiction in which the gaming machine is located. Thus, instead of generating a new paytable at the gaming machine, the gaming machine may select a new paytable from its stored database. In one embodiment, described with respect to FIG. 8, the gaming machine may contact a paytable server that includes a paytable database when it needs to update its paytable.

The gaming machine may be operable to allow a player to select a prize each time a game of chance is played on the gaming machine. However, after selecting a prize, the player may wish to play a number of games of chance in attempt to win the selected prize. For each game played, the gaming machine may not require the player to reselect their preferred prize. In particular embodiments, the gaming machine may notify the player of their current prize selection. For example, the gaming machine may display an image of the prize on one or more of its display screens with information indicating that the prize is currently designated as an outcome for the game of chance played on the gaming machine.

In other embodiments, the gaming machine may request from the player a confirmation of their desire to play for a currently designated prize. For example, the gaming machine may generate a message requesting the player to activate an input button to indicating their desire to play for the currently designated prize. The confirmation request message may be generated after particular events on the gaming machine, such as after a number of games played, after a period of inactivity, after a deposit of credits on the gaming machine or after a player tracking session is started. If the player indicates that they do not wish to continue playing for a particular prize the list of prizes available for selection in 700 may be displayed.

After playing for a selected prize for a number of games, the player may leave the gaming machine. In one embodiment, the selected prize may remain the designated prize until another player inputs a selection of a new prize. In another embodiment, after a period of inactivity on the gaming machine, the gaming machine may reset the current prize selection(s) and revert to a default prize selection(s) stored on the gaming machine.

As an example, a gaming machine may be located near a display for a motorcycle that may be won as a prize on the gaming machine. The motorcycle may be the default prize and a player playing a gaming machine near the motorcycle may expect a chance to win the motorcycle since it is displayed near the gaming machine. Another player may select a trip to win as a prize on the gaming machine instead of a motorcycle, play a number of games of chance and then leave the gaming machine. After the player leaves the gaming machine and a period of inactivity on the gaming machine, the gaming machine may switch the prize selection from the trip to the motorcycle. This capability may be used to avoid a situation where a player arrives at a gaming machine near where the motorcycle is displayed, play the gaming machine with the expectation that they can win the motorcycle as a prize and then win a prize different from the motorcycle as the result of a previous prize selection made on the gaming machine.

In step 730, a game is initiated when the gaming machine receives a game play signal. The game play signal might be initiated on the gaming machine when a player pulls a lever or presses a button on the gaming machine. Usually using a random number generator, the gaming machine determines the outcome of the game in step 740 from the pay table selected in step 720.

Prior to step 730 or as part of step 730, a wager is made on the outcome of the game of chance. The prize determined in 710 is a possible outcome for the game of chance for which the wager was made. Typically, the wager is made only on the outcome of the game of chance immediately following the wager and the outcome to the game of chance is determined independently of any previous games of chance played on the gaming machine. Thus, the prize selected in 710 may be awarded only as a result of the game of chance played immediately following the wager and after the outcome of the played game of chance is determined in 740. In a particular embodiment, the gaming machines of the present invention may only provide prize redemption of prizes that are awarded in this manner.

In step 750, game play is presented. For example, for a slot machine, game play consists of the mechanical slot reels or graphical slot reels on a video display screen rotating. The gaming machine may generate sounds, flashing lights or other effects discernible to the player while the slot reels are rotating. In step 760, the outcome of the game is presented. For example, for a slot game, the game outcome presented is usually each of the displayed slot reels stopping in a particular position. The slot game outcome is represented by the symbols displayed on each slot reel when the reels have stopped. After completing the game, a player might save prize information selected on the gaming machine to a portable storage device including a magnetic card, a smart card or a paper print-out. The prize information on the portable storage device might be used when a player wished to play for a similar prize on another gaming machine or the on the same gaming machine at a later time.

Figure 8:
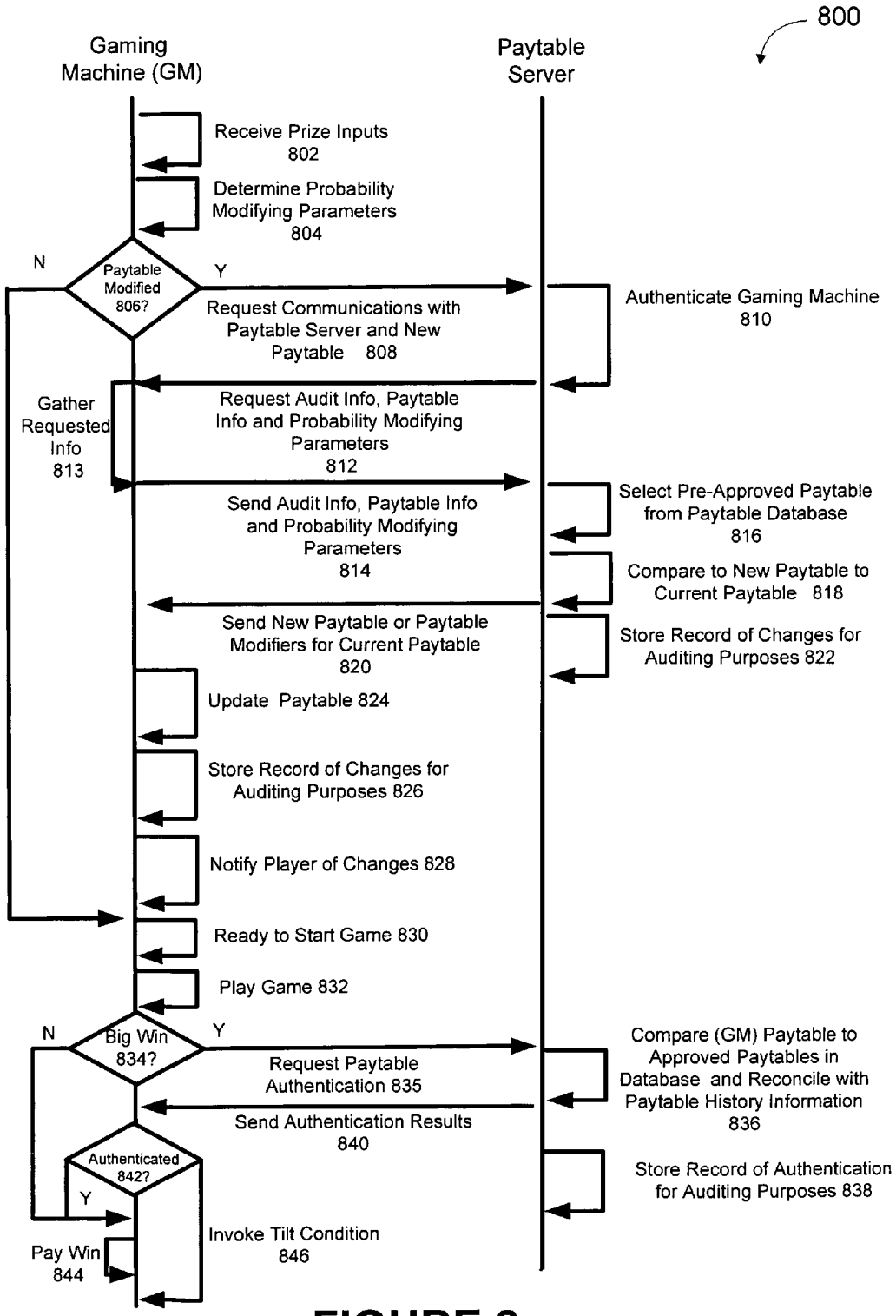
FIG. 8 is an interaction diagram showing interactions between a gaming machine and a paytable server.

FIG. 8 is an interaction diagram showing interactions between a gaming machine and a paytable server. In 802, one or more prize selections are input into the gaming machine. As described with respect to FIGS. 1-4 and 7, various means may be used to input the prize selections (e.g., via a download from a remote gaming device or via a manual input of data by a game player). In 804, the gaming machine determines what are the probability modifying parameters for the one or more prize selections. For example, as described with respect to FIG. 7, the descriptor information associated with the prize selections, such as a prize value, may be used as a probability modifying parameter. Optionally, in 804, the gaming machine may determine whether the one or more selected prizes can be matched to an outcome or outcomes in a paytable currently loaded on the gaming machine. Further, the gaming machine may determine whether the one or more selected prizes can be matched to an outcome or outcomes in other paytables stored on the gaming machine.

As described with respect to FIG. 7, the paytables stored in the gaming machine may be pre-approved for use on the gaming machine by a local gaming jurisdiction. Thus, the gaming machine may be prevented from modifying or altering data stored in the paytable under most circumstances. For example, unless specific authorization has occurred, writes to a storage media storing the paytable may be inhibited to prevent modifications to the paytable data.

In one embodiment, the gaming machine may be configured so that it can select a new paytable to use in determining a game outcome from among the pre-approved paytable but may not be permitted to modify a value stored in the paytable or generate new values for a paytable. In another embodiment, a remote gaming device, such as the paytable server, may determine the selection of the paytable. In this instance, the gaming machine may utilize the paytable selected by the paytable sever. As described as follows, the gaming machine may provide prize information to the paytable server that allows the selection of the paytable to be made. In yet other embodiments, in some instances, the gaming machine may select the paytable for use in a game of chance and, in other instances, the gaming machine may request the paytable server to make the paytable selection.

In a particular embodiment, a single paytable may be stored as a combination of a base paytable and a modifier paytable. The base paytable may be standard paytable. For each outcome defined in the base paytable, the modifier paytable may include information as to whether a modification is to be performed to the outcome in the base paytable and information specifying the modification to be performed. For example, a modifier paytable could include a multiplier for a portion or all of the outcomes in the base paytable. The multipliers may be used to adjust the probability of particular outcomes in the game of chance occurring.

One advantage of defining a paytable as a combination of a base paytable and a modifier paytable may occur when the gaming machine receives a paytable downloaded from a remote gaming device, such as the paytable server. When the modification to the base paytable is small, it may be faster to transmit a modifier paytable for the base paytable rather than transmit an entire paytable, which can be quite large. Another advantage is that the storage requirements for storing a family of related paytables that use a common base paytable and different modifier paytables may be less than storing each paytable in the family separately.

In 806, the gaming machine determines whether its current paytable is a match for the prize selection. It some instances, it may not be necessary to change paytables on the gaming machine. For example, when the prize selections available on the gaming machine are of equivalent values, one paytable may be utilized independent of the prize selected. When a change of the paytable is not required, the gaming machine may be advanced to a state in 830 where it is ready to start a game.

In 806, when a change of the paytable is required, in 808, the gaming machine may initiate communications with a remote gaming device, such as a paytable server and request a new paytable. In 810, the paytable server attempts to authenticate that the gaming machine that has sent the request. In the authentication process, the paytable server may determine whether the gaming machine is valid device with authorization to communicate with the paytable server. The gaming machine may also attempt to authenticate the paytable server. Details of a few authentication methods that may be used with the present invention are described in co-pending U.S. application Ser. No. 10/116,424, by Nguyen, filed Apr. 3, 2002 and titled, "Secured Virtual Network in a Gaming machine," which is incorporated herein in its entirety and for all purposes.

In 812, when the communications between the gaming machine and the paytable server have been authorized, the paytable server may send a message to gaming machine requesting audit information, current paytable information and probability modifying parameters. The audit information may include but is not limited to a time and date stamp, location information, one or more gaming machine serial numbers or identification numbers and current gaming machine configuration information. The audit information may be used to uniquely identify the transaction between the paytable server and the gaming machine.

The current paytable information may include identification information, such as text and/or numerical descriptors, that allow the paytable server to identify the paytable in use on the gaming machine. The modifying information may include information, such as but not limited to prize selections made by the player and a status of the player and their previous game play history. In other embodiments, a new paytable may be required when a new game is selected for play on the gaming machine. Thus, the modifying information may include information regarding a game selection made at the gaming machine.

In 813, the gaming machine may gather the information requested by the paytable server and generate a reply message. In 814, the gaming machine may send the reply message comprising the information requested by the paytable server. In 816, the paytable server receives the information from the gaming machine and uses it select a new paytable for gaming machine. Further, as is described in 836, the paytable server may optionally attempt to determine whether the current paytable used on the gaming machine is a valid paytable that is authorized for use on the gaming machine.

The validation of the current paytable in 836 may include but is not limited to comparing a hash value generated for all or portion of the paytable on the gaming machine with a hash value of a trusted copy of the paytable stored on the paytable server. The paytable server may also store records of a paytable modification history on the gaming machine. Thus, the paytable server may check its records to confirm that the current paytable being implemented on the gaming machine are consistent with its records of paytable modifications previously performed on the gaming machine. When the current paytable can't be validated, an error or tilt condition may be generated and sent to the gaming machine that causes the gaming machine to stop game play. Further, a gaming machine operator may be notified.

In 818, the paytable server may optionally compare the new paytable to the old paytable. When the differences between the new paytable and the old paytable are not that large, the paytable server may generate a modifier paytable that modifies the current paytable on the gaming machine to generate the new paytable. In 820, the paytable server may send a complete new paytable or a modifier paytable to the gaming machine. In 822, the paytable server may store a record of the transaction for auditing purposes.

In 824, the gaming machine may receive the new paytable and update its current paytable. In 826, the gaming machine may store a record of the paytable update. The record stored on the gaming machine may comprise information that can be reconciled with information stored on the paytable server. This record may be stored in a NV-memory device located on the gaming machine.

In 828, when a game player has initiated the paytable modifications, the gaming machine may optionally notify the player of the changes to the paytable. This step may be optional because a paytable technician may manually initiate a paytable modification. Further, the gaming machine or the paytable server may automatically initiate a paytable modification in which cases a notification message may not be generated. The message directed to the player may be displayed to a display screen on the gaming machine. A record, such as a capture of one or more video frames displayed to the player, indicating that the player was notified of the configuration change or configuration parameters that allow the information displayed to the player to be reconstructed may be stored on the gaming machine. This information may be used if a dispute occurs, such as the player complaining that the gaming machine configuration was changed without their knowledge and/or consent.

The confirmation message to the player may include one or more of 1) a new pay-out schedule, 2) information notifying the player pay-out schedule and probabilities have changed without indicating how the probabilities have been modified, 3) directions for accessing the pay-out schedule, 4) information indicating only what pay-outs have been changed, 5) information indicating only what probabilities have changed or 6) combinations thereof. As described above, the pay-out schedule may be changed when a non-cash prize is matched to one of the outcomes of the game of chance played on the gaming machine. In some embodiments, the gaming machine may request that the player confirm their desire to proceed to game play using the new gaming machine configuration. The confirmation may be made via an input device on the gaming machine.

In 830, the gaming machine is placed in a state where it is ready to start a game. In 832, the player may make wagers and play one or more games with a chance of winning the selected prizes. In 834, after each outcome, the gaming machine may check for a big win. The big win may be assigned to outcomes with cash or non-cash prizes above a certain value. When a big win has not occurred, the gaming machine may pay the win which may comprise adding credits to the gaming machine or redeeming a prize.

When a win is determined to be a "Big win," the gaming machine may send a message to the paytable server in 835 requesting authentication of the paytable. As described in 808, the paytable server and/or the gaming machine may attempt to authenticate each other's identity. In 836, the paytable server may compare the paytable information received from the gaming machine with its trusted information about the paytable and stored paytable history information for the gaming machine.

In 840, the paytable server may send the paytable authentication results to the gaming machine. In 842, the gaming machine may receive the information and check the authentication status of the 'Big win.' When the 'Big Win' has been authenticated the gaming machine may pay the big win or in the case of a hand pay indicate that a hand pay has been approved. When the 'Big Win' has not been authenticated, the gaming machine may invoke a tilt condition and not pay the 'Big win.'

Figure 9:
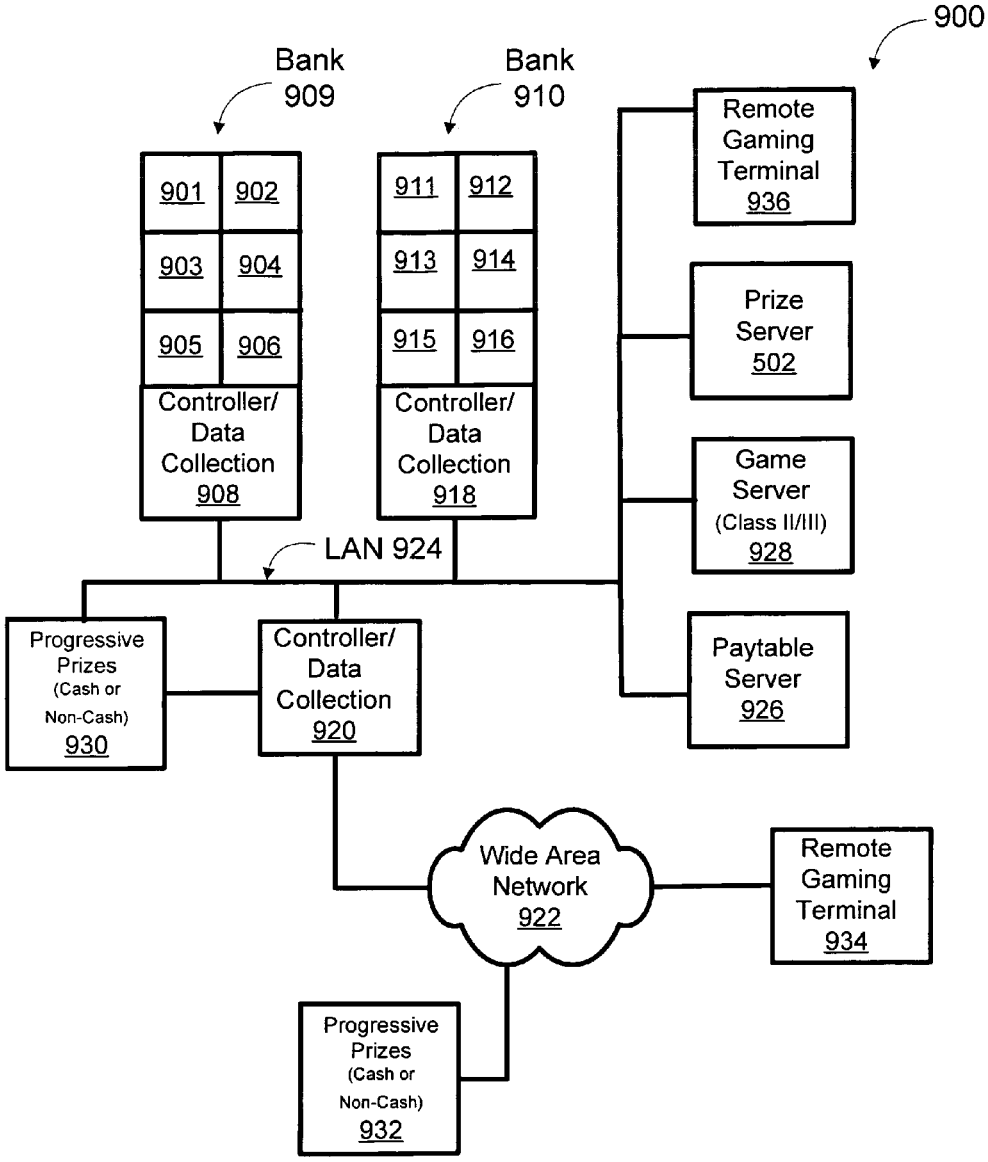
FIG. 9 is a block diagram depicting a gaming system operable to provide cash or non-cash progressive prizes.

FIG. 9 is a block diagram depicting a gaming system 900 operable to provide cash or non-cash progressive prizes. Two banks of gaming machines 909 and 910 are shown connected to a local area network 924. Banks 909 and 910 each comprise six gaming machines, 901, 902, 903, 904, 905, 906 and 911, 912, 913, 914, 915, 916, respectively. The number of gaming machines in each bank may vary.

Each bank is connected to a gaming device. The gaming devices, 908 and 918 may provide various services to the gaming machine in the bank. For example, the gaming device 908 and 918 may each act as a controller of some type, provide a network interface or provide data collection.

In one embodiment of the present invention, each of the gaming machines may be operable to contribute a portion of each wage to one or more progressive prize pools. The progressive prize pool may be used to fund cash or non-cash progressive prizes that may be awarded at each of the gaming machines. A house is one example of a large value non-cash progressive prize that may be won at the gaming machines.

As described with respect to FIGS. 1-8, the gaming machines were operable to allow selections between different non-cash prizes and different combinations of non-cash prizes and cash prizes that are awarded at the gaming machine. The gaming machines of the present invention may also be operable to allow selections of different non-cash prizes as awards for progressive games. For example, a gaming machine may be operable to allow a player to select between an award of a high-definition television or a Lap-top computer as an outcome for a progressive game. Details of providing selections of progressive awards that may be used with the present invention are described in co-pending U.S. application Ser. No. 10/958,843, filed Oct. 4, 2004 and titled, "Wide Area Progressive Jackpot System and Methods," which is incorporated herein by reference and for all purposes.

The progressive pools may be implemented over varying numbers of gaming machines. The number of gaming machines in a progressive pool as well as denomination of a progressive game may affect a value of progressive prize to be awarded. For example, one or more progressive games may be implemented using the gaming machine in banks, 909 or 910. The gaming devices, 908 and 918, may gather data from the gaming machines in the banks to determine the size of the progressive pools for each of their respective banks.

As another example, progressive prize pools may be implemented over a number of gaming machines at a particular gaming location, such as over different gaming machines located at a casino. For example, via gaming devices, 908, 918 and 920, various gaming machines may be contribute to one or more progressive prize pools that are maintained at gaming device 930. For cash progressive prizes, gaming device 930 may determine the current size of a progressive jackpot and broadcast the progressive jackpot size to a number of gaming machines. For non-cash progressive prizes, the gaming device 930 may maintain an amount contributed to the non-cash progressive prize pool. However, it may not be necessary to broadcast the amount contributed to the non-cash progressive jackpot to the gaming machines. Instead, the gaming device 930 may broadcast the non-cash progressive prizes associated with the progressive pool, which, as described below, may change with time.

The progressive pools of the present invention may be implemented over a wide area network, 922. In a wide area progressive game, data gathered from gaming machines at different locations may be forwarded to a remote gaming device, such as 932. For instance, gaming device 932 may receive contributions to a progressive pool from gaming device 920 at a first location, such as a casino, and a remote gaming terminal 934 at a second location, such as at an airport via the wide area network 922. The wide area network 922 may comprise a dedicated private network, virtual private network implemented on a public network, such as the Internet, or combinations thereof. Details of the network topology and methods implementing and utilizing different topologies are described in co-pending U.S. application Ser. No. 10/116,424, previously incorporated herein.

When a non-cash progressive prize funded by the progressive pool is fully funded, a number of actions may be implemented. In one embodiment, a casino or a company that has agreed to provide the non-cash prize as an award may keep a portion of contributions to the progressive pool above the amount used to fund the non-progressive prize. When a progressive prize is first provided and awarded, the amount in the progressive pool may be lower than the value of the non-cash progressive prize. Thus, the portion of contribution above the amount used to fund the non-progressive prize may be awarded to the provider of the prize. The additional revenue may allow the provider of a prize to purchase insurance against the event that the non-cash prize is awarded at a loss.

In another embodiment, a portion of the contributions above the fully funded value of the non-cash prize may be awarded to a winner of the prize to help them pay taxes on the prize. In yet another embodiment, a portion of the contributions above the fully funded value of the non-cash prize may be used to add additional non-cash prizes or cash prizes to the progressive prize as the progressive prize pool grows. In this embodiment, the gaming device providing progressive prize services may send updates to the gaming machines eligible to win the progressive prize. The updates may include information regarding a composition of the progressive prize. These updates may be displayed on the gaming machine.

In general, the progressive prizes of the present invention may comprise cash-only prizes, one or more non-cash prizes or combinations thereof. As described in the preceding paragraph, the composition of the progressive prize can change over time. For example, a progressive prize can start with a cash prize and a non-cash prize where the value of the cash prize increases with time. As another example, a progressive prize can start with a non-cash prize and additional non-cash or cash prizes can be added to the progressive prize over time. In each of these examples, a player may be provided an opportunity to select between different non-cash prizes as an award for the non-cash component of the progressive prize.

In addition, a player may be provided an opportunity to select the composition or the mix of the progressive prize. For example, when the progressive prize includes a cash component and a non-cash component, the player may be allowed to lower the value of the cash component so that non-cash prizes of a greater value can be selected. In particular, different groups of non-cash prizes may be available where a player may be able to select one or more non-cash prizes from a group. Depending on the value of a cash component that a player has selected, the player may be granted access to different groups of non-cash prizes. The player may be allowed to select prizes from the groups that are accessible to them. Conversely, a player may be allowed to increase the value of the cash component of the progressive but then the value of the non-cash prize(s) in a non-cash component of the progressive prize that they can select may be lowered.

In one embodiment of the present invention, non-cash prizes that may be offered for selection as part of a progressive prize at a gaming machine may change as an amount contributed to the progressive jackpot increases. For example, when the amount contributed to the progressive jackpot is within a first range, a remote gaming device, such as 908, 930 or 932, may send a message to gaming machines indicating that a first group of non-cash prizes is available for selection as an award for the progressive game. Next, when the amount contributed to the progressive jackpot increases such that it enters a second range greater than the first range, a second group of non-cash prizes may be made available for selection.

The remote gaming device tracking the contributions to the progressive prize pool may notify gaming machines of the new prizes in the second group that are available for selection. Alternatively, the remote gaming device may contact the prize server 502 which may then notify the gaming machines of the new prizes. In one embodiment, when the amount in the progressive prize pool enters the second range only selections from the second group are allowed at the gaming machines and the prizes in the first group are no longer available. In other embodiments, one or more prize selections may be made from each of the first group and the second group.

As describe with respect to FIG. 7, a default prize may be designated for each group. Thus, when the gaming machines are updated with a new group of prizes from which prize selections may be made, the gaming machine may designate or may receive instructions to designate one prize in the new group as the default prize. As described above, the gaming machine may be operable to allow a player to select a prize other than the default prize as an outcome for the progressive game. The player may make the selection of a preferred prize manually, such as via input buttons or a touch screen interface coupled to the gaming machine, or the selection may be made automatically using prize preference information stored on a remote gaming device in communication with the gaming machine or by reading prize preference information from an instrument presented at the gaming machine.

In the present invention, games of chance including progressive games where a selection between non-cash prizes is allowed may be provided at remote gaming terminals, such as 934 or 936. In one embodiment, the gaming machines in banks 909 or 910, which may be located on a casino floor and may be configured with regulated gaming software approved for use in a gaming establishment, may be configured to provide games of chance to the remote gaming terminals 934 and 936.

When a player wishes to play a game of chance on one of the remote gaming terminals, a communication connection may be established between the gaming terminal and one of the gaming machines. In one embodiment, a gaming machine may be configured to simultaneous provide a game of chance to a player at the gaming machine (player inputs are received via input mechanisms directly coupled to the gaming machine) and to players at one or more remote gaming terminals. In another embodiment, the gaming machines may provide either a local gaming session to a player at the gaming machine or a remote gaming session to a player at a remote gaming terminal. In this case, a connection may be made between the remote gaming terminal and an idle gaming machine not currently being utilized by a game player.

In a particular embodiment, local game players may be given priority over remote game players. Thus, when a player wishes to play a game of chance locally on the gaming machine, i.e., the player is physically present at the gaming machine and the gaming machine provides either a local gaming session or a remote gaming session but not both simultaneously, the gaming system 900 may be operable to switch the remote gaming terminals, 934 and 936, to different gaming machines as they become available. A server connected to the local area network 924 may be used to monitor the status (in-use or idle) of the gaming machines that provide remote game play and switch the remote gaming terminals to different idle machines during a game play session on the remote gaming terminal. When all the gaming machines are in use, the remote gaming terminals may not provide game play until a gaming machine becomes available.

The use of idle gaming machines in a gaming establishment, such as a casino, to provide remote game play may be desirable to both game players and gaming machine operators. Game players may desire this approach because they can be assured that they are being provided the same "fair" game that they would be provided if they played the gaming machine at the gaming establishment. They may even be familiar with games provided at the gaming establishment from previous visits. Gaming machine operators may desire this approach because it allows gaming machines on the casino floor to generate revenue when they become idle.

In another embodiment, a game server 928 may be used to provide remote game play to the remote gaming terminals 934 and 936. The game server 928 may execute gaming software that is approved for use on the gaming machines available for local game play, such as the gaming machines in banks 909 and 910. The game server 928 may be located in area separate from the other gaming machines that is not accessible to game players. Thus, local game play may not be available on the game server 928. Details of methods and apparatus for providing remote game play on gaming machines and game servers is described in co-pending U.S. application Ser. No. 11/014,150, by Wells, filed Dec. 14, 2004 and titled "Wireless Game Player," which is incorporated herein by reference and for all purposes.

In yet another embodiment of the present invention, a server, such as 928, in communication with one or more gaming machines may determine outcomes for games played on the gaming machines. For example, a central server may provide lottery games, keno games and bingo games to a plurality of gaming machines in communication with the central server. Each of the games involves purchasing a set of numbers, which can be matched to a set of numbers generated on the central server. The gaming machines of the present invention may be operable to provide locally determined games where the game outcomes are determined on the gaming machine, such as slot machines, and centrally determined games, such as bingo games, keno games, pull-tab type games and lottery games where the game outcomes are not determined on the gaming machine.

As an example of centrally determined games, two forms of Bingo are described. In traditional Bingo, the players purchase cards after which a draw takes place. The first player to achieve a designated pattern wins. In one type of Bingo game known as Bonanza Bingo, the draw for the game takes place before the players know the arrangements on their Bingo cards. After the draw occurs, the players purchase cards and compare the arrangements on the cards to the drawn numbers to determine whether predetermined patterns are matched. Play continues in Bonanza Bingo until at least one of the players matches a designated game-winning pattern. Bonanza Bingo may also encompass Bingo variations wherein a partial draw is conducted for some numbers (generally fewer than the number of balls expected to be necessary to win the game) prior to selling the Bingo cards. After the Bingo cards are sold, additional numbers are drawn until there is a winner.

As indicated above, a Bingo game is played until at least one player covers a predetermined game-winning pattern on the player's Bingo card. The game may also include interim winners of prizes based on matching predetermined interim patterns on the Bingo card using the same ball draw. The interim pattern wins do not terminate the Bingo game. For interim pattern awards, players covering certain interim patterns may receive an additional award as the game continues. Some exceptional Bingo versions may allow Bingo draws beyond those needed to achieve the Bingo game win so as to payout interim pattern wins at a desired rate. The game-winning awards may be partially or fully pari-mutuel in nature. That is, the Bingo win award is based upon the total amount wagered on a given occurrence of the Bingo game. However, interim pattern awards typically are not pari-mutuel. In the present invention, a player may be allowed to select between non-cash prizes that may be awarded as an outcome for the bingo games and other centrally determined games.

For a given game-winning pattern, the expect number of balls drawn for at least one Bingo card to match the game-winning pattern depends on the number of Bingo cards being played in the Bingo game. Bingo is typically played with a variable number of Bingo cards resulting from varying numbers of players and players playing varying numbers of Bingo cards. Consequently, if the interim patterns are evaluated based on the balls drawn until at least one Bingo card matches the game-winning pattern, the odds of awarding interim awards also varies with the number of Bingo cards being played in the Bingo game. If the interim awards are determined based on the ball draw to Bingo, the Bingo game may be restricted to a fixed number of Bingo cards in order to achieve a desired payout rate for the interim pattern awards. Details of a bingo methods and apparatus that may be used with the present invention are described in co-pending U.S. application Ser. No. 10/925,710, filed Aug. 24, 2004, Gail et al., and titled "Draw Bingo," and described in co-pending U.S. application Ser. No. 10/995,636, filed Nov. 22, 2004, by Nguyen and titled "Class II/Class III Hybrid Gaming Machine, System and Methods," each of which is incorporated by reference and for all purposes.

Although the foregoing invention has been described in some detail for purposes of clarity of understanding, it will be apparent that certain changes and modifications may be practiced within the scope of the appended claims. For instance, while the gaming machines of this invention have been depicted as having gaming devices physically attached to a main gaming machine cabinet, the use of gaming devices in accordance with this invention is not so limited. For example, the display screen features which may be provided on a top box may be included in a stand alone cabinet proximate to, but unconnected to, the main gaming machine chassis.

What is claimed is:

1. A method of awarding prizes on a gaming machine providing wagering on a game of chance, the method comprising;

providing a memory on the gaming machine storing a paytable for the game of chance wherein the paytable includes each possible outcome for the game of chance and odds associated with each possible outcome;

prior to determining an outcome of the game of chance, receiving via first input mechanism coupled to the gaming machine a selection of a non-cash prize from among two or more non-cash prizes available for selection on the gaming machine;

in response to receiving the prize selection, matching the selected non-cash prize to at least a first game outcome in the paytable;

receiving via a second input mechanism coupled to the gaming machine a wager for the game of chance;

after receiving the prize selection and matching the prize selection to the first game outcome, determining the outcome for the game of chance using a random number generator and the paytable including the first game outcome;

presenting the outcome for the game of chance on a video display device coupled to the gaming machine; and indicating an award of the selected non-cash prize on the video display device when the determined outcome for the game of chance is the same as the at least first game outcome matched to the selected non-cash prize.

2. The Method of claim 1, further comprising receiving a download of information describing prizes available for selection on the gaming machine from a remote gaming device.

3. The Method of claim 2, further comprising displaying a list of prizes including the downloaded prizes available for selection on a display mechanism coupled to the gaming machine wherein the list of prizes include at least two or more non-cash prizes.

4. The Method of claim 1, wherein the paytable is approved for use on the gaming machine by a gaming authority with jurisdiction to specify operating parameters for the gaming machine.

5. The Method of claim 1, further comprising: preventing modification of information stored in the paytable.

6. The Method of claim 5, wherein writes to a storage medium storing the paytable are inhibited to prevent modification to the paytable.

7. The Method of claim 1, wherein prior to the match of the selected non-cash prize to the first outcome, an award for the first outcome is a first cash prize or a first non-cash prize different from the selected non-cash prize.

8. The Method of claim 1, wherein the odds of the first outcome occurring are not changed by the match of the selected non-cash prize to the first outcome.

9. The Method of claim 1, further comprising: matching the selected non-cash prize to a second outcome stored in the paytable different from the first outcome and awarding the selected non-cash prize when the first outcome or the second outcome occurs.

10. The Method of claim 9, matching the selected non-cash prize to the second outcome when a bonus event is detected on the gaming machine.

11. The Method of claim 1, further comprising: matching the selected non-cash prize to a second outcome stored in the paytable different from the first outcome wherein the odds of the second outcome occurring are different from the first outcome and awarding the selected non-cash prize when the second outcome occurs.

12. The Method of claim 11, wherein the odds of the second outcome occurring are greater than the odds of the first outcome occurring and wherein the selected non-cash prize is switched to the second outcome when a bonus event is detected on the gaming machine.

13. The Method of claim 1, further comprising: automatically switching a current prize selection on the gaming machine to a default prize selection wherein the default prize selection is a cash prize or a non-cash prize.

14. The Method of claim 13, making the switch from the current prize selection to the default prize selection after detecting a period of inactivity on the gaming machine.

15. The Method of claim 1, further comprising: receiving an input signal to confirm that a game player currently utilizing the gaming machine wishes to play the game of chance for the non-cash prize that is currently selected.

16. The Method of claim 1, further comprising: receiving the information for selecting the at least one non-cash prize from a remote gaming device in communication with the gaming machine or from an instrument read at the gaming machine.

17. The Method of claim 16, wherein the received information is for a first non-cash prize previously selected by a game player.

18. The Method of claim 16, wherein the received information is for a suggested non-cash prize.

19. The Method of claim 18, wherein the suggested non-cash prize is determined from one or more non-cash previous prize selections made by a game player and wherein the suggested non-cash prize is different from the one or more previous non-cash previous prize selections made by the game player.

20. The Method of claim 18, wherein the suggested non-cash prize is determined using personal information gathered from a game player.

21. The Method of claim 16, wherein the instrument is one of a printed media, a magnetic striped card, a smart card, a cell phone, a personal digital assistant, a portable electronic device or an RFID enabled device.

22. The Method of claim 1, after receiving information for selecting the at least one non-cash prize, determining whether the gaming machine is operable to provide the award of the at least one non-cash prize.

23. The Method of claim 1, further comprising: determining that a new paytable different the paytable is needed to provide the award of the at least one selected non-cash prize.

24. The Method of claim 23, further comprising: selecting the new paytable from a database of paytables stored on the gaming machine.

25. The Method of claim 24, wherein the new paytable is pre-approved by gaming regulators for use on the gaming machine.

26. The Method of claim 23, further comprising: sending a message to request the new paytable to a remote gaming device and receiving the new paytable from the remote gaming device.

27. The Method of claim 23, further comprising: determining the outcome for the game of chance with the new paytable.

28. The Method of claim 1, further comprising: sending a first message to request an authentication of the paytable to a remote gaming device and receiving a second message from the remote gaming device indicating an authentication status of the paytable.

29. The Method of claim 1, further comprising: changing the paytable used to determine the outcome of the game of chance.

30. The Method of claim 29, further comprising: storing a record describing the change of the paytable to a non-volatile memory on the gaming machine.

31. The Method of claim 1, further comprising: contributing a portion of the wager for the game of chance to a progressive prize pool.

32. The Method of claim 1, wherein the at least one non-cash prize is a non-cash progressive prize.

33. The Method of claim 1, further comprising receiving from a remote gaming device information describing a first group of non-cash progressive prizes wherein the at least one non-cash prize is selected from the first group.

34. The Method of claim 33, further comprising receiving from the remote gaming device information describing a second group of non-cash progressive prizes wherein the at least one non-cash prize is selected from the second group and wherein the value of the prizes in the second group is greater than the value of the prizes in the first group.

35. The Method of claim 1, wherein the at least one non-cash prize is displayed on a mechanical wheel or a video wheel.

36. The Method of claim 35, further comprising: receiving an input signal to spin the mechanical wheel or the video wheel wherein a final position of the video wheel or the mechanical wheel is used to select the at least one non-cash prize.

37. The Method of claim 36, further comprising: randomly generating the final position of the mechanical wheel or the video wheel and moving the mechanical wheel or the video wheel from an initial position to the final position.

38. The Method of claim 35, further comprising: receiving one or more input signals to rotate the video wheel or the mechanical wheel from a first position to a second position wherein a position of the video wheel or the mechanical wheel relative to a selector is used to select the at least one non-cash prize.

39. The Method of claim 1, further comprising: displaying a message indicating that the paytable or a pay-out schedule used to generate the game of chance has been changed.

40. The Method of claim 39, further comprising: receiving an input signal to acknowledge receipt of the message by a player at the gaming machine.

41. The Method of claim 1, further comprising: storing a record including information indicating that a player has been notified of a change to a pay-out schedule or the paytable used to generate the game of chance.

42. The Method of claim 41, wherein the record includes a copy of a video frame displayed on the gaming machine and wherein the video frame includes a message indicating that the payout schedule or the paytable has been changed.

43. The Method of claim 41, wherein the record is stored on a non-volatile memory device.

* * * * *